US008739792B2

(12) United States Patent
Holley et al.

(10) Patent No.: US 8,739,792 B2
(45) Date of Patent: Jun. 3, 2014

(54) HYPERBARIC EXERCISE FACILITY, HYPERBARIC DOME, CATASTROPHE OR CIVIL DEFENSE SHELTER

(71) Applicants: Merrell T. Holley, Morgan City, LA (US); James L. Schmidt, Pigeon Forge, TN (US)

(72) Inventors: Merrell T. Holley, Morgan City, LA (US); James L. Schmidt, Pigeon Forge, TN (US)

( * ) Notice: Subject to any disclaimer, the term of this patent is extended or adjusted under 35 U.S.C. 154(b) by 74 days.

(21) Appl. No.: 13/663,566

(22) Filed: Oct. 30, 2012

(65) Prior Publication Data

US 2013/0111826 A1 May 9, 2013

Related U.S. Application Data

(63) Continuation of application No. 12/276,990, filed on Nov. 24, 2008, now Pat. No. 8,297,282.

(60) Provisional application No. 60/989,889, filed on Nov. 23, 2007.

(51) Int. Cl.

| | |
|---|---|
| ***A61G 10/00*** | (2006.01) |
| ***A62B 31/00*** | (2006.01) |
| ***E04B 1/32*** | (2006.01) |
| ***E04B 1/342*** | (2006.01) |
| ***E04B 7/08*** | (2006.01) |

(52) U.S. Cl.
USPC ..... 128/205.26; 52/80.1

(58) Field of Classification Search
USPC ..... 128/205.26, 202.12, 200.24; 52/80.1, 52/2.15; 454/238, 355, 340, 70
See application file for complete search history.

(56) References Cited

U.S. PATENT DOCUMENTS

| | | | | |
|---|---|---|---|---|
| 3,316,828 | A * | 5/1967 | Boehmer | 454/238 |
| 3,548,516 | A * | 12/1970 | Lanphier et al. | 434/254 |
| 4,077,177 | A * | 3/1978 | Boothroyd et al. | 52/745.07 |
| 4,195,949 | A * | 4/1980 | Reiher | 405/185 |
| 4,227,524 | A * | 10/1980 | Galerne | 128/205.26 |
| 4,324,074 | A | 4/1982 | South et al. | |
| 4,427,385 | A * | 1/1984 | Galerne | 434/29 |
| 5,918,438 | A | 7/1999 | South | |
| 6,325,012 | B1 * | 12/2001 | Aristizabal | 114/314 |
| 6,840,013 | B2 | 1/2005 | South | |
| 7,588,517 | B2 * | 9/2009 | Richardson | 482/51 |
| 2013/0111826 | A1 * | 5/2013 | Holley et al. | 52/80.1 |

FOREIGN PATENT DOCUMENTS

| | | |
|---|---|---|
| EP | 0357151 | 3/1990 |
| JP | 10061014 | 3/1998 |

* cited by examiner

*Primary Examiner* — Lynne Anderson
*Assistant Examiner* — Bradley Philips
(74) *Attorney, Agent, or Firm* — Garvey, Smith, Nehrbass & North, L.L.C.; Brett A. North

(57) ABSTRACT

A hyperbaric exercise facility is provided allowing a persons to perform exercises and other activities at increased pressures along with controlled levels of oxygen. Additionally, a catastrophe shelter is provided to protect its occupants from peril.

18 Claims, 19 Drawing Sheets

HYPERBARIC EXERCISE FACILITY, HYPERBARIC DOME, CATASTROPHE OR CIVIL DEFENSE SHELTER

CROSS-REFERENCE TO RELATED APPLICATIONS

This is a continuation of U.S. patent application Ser. No. 12/276,990, filed Nov. 24, 2008, (issuing as U.S. Pat. No. 8,297,282 on Oct. 30, 2012), which was a non-provisional of U.S. Provisional Patent Application Ser. No. 60/989,889, filed Nov. 23, 2007. Both of these applications are incorporated herein by reference and priority to each is hereby claimed.

BACKGROUND

The term "hyperbaric" is used herein to mean a pressure greater than ambient, over and above the range of pressure variation encountered in the course of normal fluctuations in atmospheric pressure caused by changes in the weather. In one embodiment pressures between 1.2 and 1.6 atmospheres are contemplated. In various embodiments higher pressures can be used. In various embodiments lower pressures can be used.

A variety of acute, subacute and chronic conditions related to brief or prolonged exposure to altitude (or to decompression, in the case of divers and others working at elevated pressure) are nevertheless alleviated by treatment in a hyperbaric atmosphere.

In one embodiment is provided a hyperbaric training facility, providing an environment of elevated pressure. In one embodiment, the facility serves as an exercise environment, permitting an improved endurance training regimen. In another embodiment, the facility is adapted for the emergency treatment of various pressure changing sicknesses, such as "mountain sickness" or acute pulmonary edema.

In one embodiment is provided an exercise facility where training exercises at atmospheric pressures greater than normal pressure at sea level. This embodiment allows persons exercising at elevated pressures (compared to one atmosphere at sea level) regardless of the ambient exterior pressure.

Air-supported structures, tennis domes, radar domes and the like are distinguished from the devices of the present invention by the fact that only a minuscule increment of pressure is needed to maintain such structures in an inflated condition. For example, a pressure differential of only 70 mm water pressure is all that is required to maintain the rigidity of a radar dome of 15 meter diameter in winds up to 240 mph. In units of pounds per square inch ("psi"), 70 mm of water is approximately 0.1 lb/sq. inch, an amount within the range of normal atmospheric fluctuations due to weather conditions and not hyperbaric as herein defined. Examples of air-supported, but nonhyperbaric structures are shown by Dent, R. M., Principles of Pneumatic Architecture (1972), John Wiley & Sons, Inc., New York; by Riordan, U.S. Pat. No. 4,103,369; and by Jones III, U.S. Pat. No. 3,801,093.

Accordingly, it is desired to provide a hyperbaric exercise facility which overcomes the disadvantages of the prior art.

SUMMARY

In one embodiment, there is provided a hyperbaric enclosure for use by an individual for a beneficial health-related effect. In one embodiment, this enclosure can be in the form of a single piece dome which is seamless to avoid localization/enhancement of stresses.

In one embodiment, the facility is at least partially spherical/hemispherical which increases the ability to handle elevated interior pressures.

In one embodiment, the facility is relatively impermeable in order to maintain constant elevated pressure without substantial air leakage.

In one embodiment, the facility provides at least one airlock to allow entering and exiting of the interior without losing a substantial amount of interior pressure.

In one embodiment, the facility provides at least one double ended airlock the chamber that can remain pressurized indefinitely, eliminating cycling time and associated stresses with individuals entering and leaving interior.

In one embodiment, the facility is of a reinforced concrete construction.

In one embodiment, the facility is in the form of a concrete dome that is fireproof, providing safety for human occupants.

In one embodiment, the interior pressures can be provided by a compressor, blower, and/or bottled gasses.

In one embodiment, the facility is at least one pressure regulator to display and regulate internal pressure In one embodiment, the facility provides at least one grade beam that is extended well below finished floor elevation and integrally tied to a thin-shell concrete dome with reinforcement material (rebar, rods, post-tensioning wire cable, mesh, fabric, etc) to eliminate local stresses at intersection of floor and dome shell.

In one embodiment, the apparatus features a grade beam that ensures structure integrity in the event of soil subsidence or seismic activity.

In one embodiment, the apparatus features a concrete floor that rests upon thickened section of grade beam to prevent downward thrust.

In one embodiment, the apparatus features optional post-tensioning cables, arranged latitudinally and longitudinally, and torqued to increased measured values. Cables can be used to bind a thin-shell concrete dome and foundation integrally together and making the chamber highly resistant to soil subsidence, earthquake, tornadoes, hurricanes.

In one embodiment, the apparatus features a half-sphere, post-tensioned concrete, double airlock shell with pressurization equipment (e.g. compressor) and a pressure regulator.

Various embodiments are adapted to achieve specific beneficial effects, including, but not limited to increased beneficial results from exercising at hyperbaric pressures, relief from altitude sickness, pulmonary edema, rapid decompression, and improved endurance conditioning for athletes.

In one embodiment is provided a spherical or near-spherical shell (along at least one axis of symmetry), construction of nonbreathable material (or semi-permeable material) for achieving and maintaining air (or other gas mixture) pressure inside the interior which can be adjustable from 0-10 lbs. per square inch greater than ambient, and preferably 0.2-10 lbs per square inch greater than ambient, and means for ingress and egress which can be closed to prevent air loss.

In one embodiment is provided geodesic construction (along at least one axis of symmetry), construction of nonbreathable or semi-permeable material for achieving and maintaining air (or other gas mixture) pressure inside the interior which can be adjustable from 0-10 lbs. per square inch greater than ambient, and preferably 0.2-10 lbs per square inch greater than ambient, and means for ingress and egress which can be closed to prevent air loss.

In one embodiment is provided constructions for achieving and maintaining air or other gas mixture pressure inside the chamber from 0.2 psi to 10 psi greater than ambient and in preferred embodiments the pressure is achieved and maintained in the range from 0.2 psi to 4 psi above ambient.

In one embodiment is provided a hyperbaric exercise training facility having a 40 to 1,000 foot diameter size, greater or lesser, made of a nonbreathable concrete material that can be pressurized to hyperbaric pressure using air pumping equipment such as an air compressor and/or blower. The air can be continuously circulated in the facility by simultaneously controlling the internal pressure by means of an inlet valve and an exhaust valve.

In one embodiment inside the training facility can be a gym, providing exercise equipment such as weight machines, treadmills, exercise bikes, free weights, rowing machines, ski machines, training equipment.

In one embodiment various control instruments can be added, such as a barometer, along with devices to measure heart rate, blood plasma oxygen levels, breathing rate or body temperature of the individuals using the exercise equipment.

In one embodiment these measurements can be remotely monitored using wireless devices and provided to data acquisition devices and to detect and react to key values.

In various embodiments, the hyperbaric exercise facility can be constructed to design standards of, and will receive from, the US Coast Guard a certification of PV-HO, designating a pressure vessel rated for human occupancy. There are no rigid domes in existence which have such a designation.

In one embodiment, the hyperbaric exercise facility is used for hyperbaric exercise training.

In one embodiment, the hyperbaric exercise facility is used for training and/or testing in the fields of military, aerospace, or diving. In various embodiments, the hyperbaric dome has a very high resistance to wind loads and seismic events, making an ideal catastrophe shelter for tornadoes, hurricanes, earthquakes.

In one embodiment, the hyperbaric exercise facility can be used for endurance conditioning by carrying out various exercise routines in a training regimen.

In one embodiment a maximum benefit can be obtained by exercising daily within the hyperbaric exercise facility exerciser for a sufficient period to elicit maximum cardiopulmonary performance.

In one embodiment one or more far infrared saunas are provided. These saunas can be used with various treatment schemes such as removal of various environmental toxins, deep tissue regeneration, and various other items.

In one embodiment the color temperature of lighting can be changed. In one embodiment this can be done on a programmed basis. In one embodiment a selection of a plurality of pre-programmed light and/or temperature scenarios can be provided. In one embodiment the selected scenario can be implemented during an exercise regime. In one embodiment the user can select an individual pre-programmed selections. In one embodiment the program varying in at least a plurality of ways the color temperature, and/or wavelength, and/or frequency.

In one embodiment is provided a hyperbaric exercise facility wherein the pressure inside the hyperbaric facility is increased from ambient pressure levels to allow more efficient athletic and fitness training, including cardiovascular training.

In one embodiment a hyperbaric dome is constructed of reinforced concrete material. The dome has means for ingress and egress which may be closed to provide an essentially air-tight seal. Means for pressurizing the dome and achieving an elevated pressure and valve means for controlling air pressure are provided. Optionally, means for scavenging excess moisture and carbon dioxide from the interior may be provided. Double airlocks allow for the change of occupants without the need to de-pressurize the dome.

In one embodiment is provided a catastrophe shelter for civil defense, homeland security, and military applications to protect occupants against natural and manmade catastrophes, terrorist attacks, environmental and climatalogical (including the ability to modify interior pressure variants to external barometric pressure), biological warfare agents, chemical warfare agents, and nuclear or radiological blasts and radioactive fallout. This embodiment can be provided with separate airlocks and separate air supplies for decontamination and quarantine, all with varying bariatric pressures user programmable upon requirements and from which access can be provided directly into chamber. Design parameters can be increased for added protection, such as increasing the thickness of the high performance concrete, together with specific types of reinforcements, to provide impact resistance.

A deformable and trimmable rigid emergency repair kit, typically made from metallic sheets or Kevlar, carbon, or graphite fibers, can be provided which can be rapidly deployed to prevent depressurization from bullet, shrapnel, or rocket penetrations. Anchored in place by quick setting epoxy or cements, followed by applying layers of quick-setting high performance cements, such as magnesium oxide, for a permanent or semi-permanent repair.

Air quality can be insured on the incoming process airstream used for pressurization by: high efficiency particulate filtration; adiabatic compression to rapidly increase the temperature to 600 degrees F. or greater, followed by a rapid decrease of pressure which serves to sterilize biologicals and cause molecular dissociation of volatile organic compounds. Plasma, either hot or cold but preferably cold can sterilize biologicals and cause molecular dissociation of volatile organic compounds when air is passed through the corona, (with enhanced effects if pure oxygen is introduced) generating mono-atomic allotropes of oxygen which is highly oxidative. Introducing hydrogen peroxide can be used to generate highly reactive hydroxyl ions, where the allotropic oxygen and hydroxyl ions may be blended, if desired, by user programmability. Ultraviolet radiation in the C-band, centering at or about 254 nm in wavelength can be employed.

Excess ions, both hydroxyl and ozone, as well as volatile organic compounds (VOC's), can be removed from the incoming and re-circulated airstreams by an activated carbon filter media affixed across the airstream. Impregnating the activated carbon with selected dopants, such as potassium iodide, can enhance the removal of high and low molecular weight VOC's.

The amount of ions in the air can be regulated using an automated system. The same methods can be utilized for insuring interior air quality as it is being re-circulated through climate control apparatus, either before or after. Self-contained living quarters can be provided with varying bariatric levels for short or long term length of stay.

Another embodiment of this invention is a closed circuit rebreather which includes the use of an oxygen source and carbon dioxide removal means. This allows the invention to be used without continuous pumping or other attention for a period of hours.

"Rebreather" means an embodiment of this invention which is large enough to hold a sufficient volume of air for a human to breathe during a period of time sufficient for an attendant to take care of necessary maintenance tasks other than air maintenance, preferably one-half hour or more. The rebreather must be substantially leak proof, and is large enough to contain a whole human body.

This closed-circuit breathing system supplies air, preferably not oxygen-enriched, at whatever pressure desired, for periods of time (preferably at least about six hours) depending on the amount of oxygen in the oxygen source and the capacity of the carbon dioxide removal means. This embodiment also dispenses with the need for constant monitoring and adjustment of oxygen flow. It is used preferably in mountain environments, but may also be used in any environment where an extended period must be spent in an enclosed space, such as underground or under water. In such environments, the preferred pressure to be maintained within the bubble is atmospheric pressure.

In this embodiment, an oxygen source, preferably a container of compressed oxygen, is connected to the interior of the chamber through a pressure regulator such that oxygen is bled into the chamber in response to a pressure drop below a preselected pressure. As the air inside the facility is breathed, oxygen is converted to carbon dioxide and exhaled into the facility. The carbon dioxide is then removed by the carbon dioxide removal means inside the facility. The original gas composition inside the facility can be any breathable mixture, including an enriched oxygen mixture.

The exerciser embodiment is intended to achieve the following goals: to provide a structure capable of maintaining in its interior an elevated pressures above ambient, allowing individuals to carry out fitness training using training equipment, and to provide an exercise method for athletes desiring maximal endurance conditioning.

While certain novel features of this invention shown and described below are pointed out in the annexed claims, the invention is not intended to be limited to the details specified, since a person of ordinary skill in the relevant art will understand that various omissions, modifications, substitutions and/or changes in the forms and details of the device illustrated and in its operation may be made without departing in any way from the spirit of the present invention. No feature of the invention is critical or essential unless it is expressly stated as being "critical" or "essential."

FIGURES

DETAILED DESCRIPTION

The various embodiments herein described, as well as other embodiments constructed according to the teachings herein, have many structural features in common.

In one embodiment, a specially engineered and specially constructed dome is used for a hyperbaric chamber which can substantially increase the size of the confined space compared to a rectilinear or cylindrical format. The geometric increase in volume allows enough space to avoid being in a clinical situation and substantially reducing and/or eliminating claustrophobia which is a major objection to hyperbaric structures (such as that used for hyperbaric oxygen therapy). The economy of scale provided with this embodiment can substantially revolutionize the capacity and costs of construction and usage.

Figure 1:
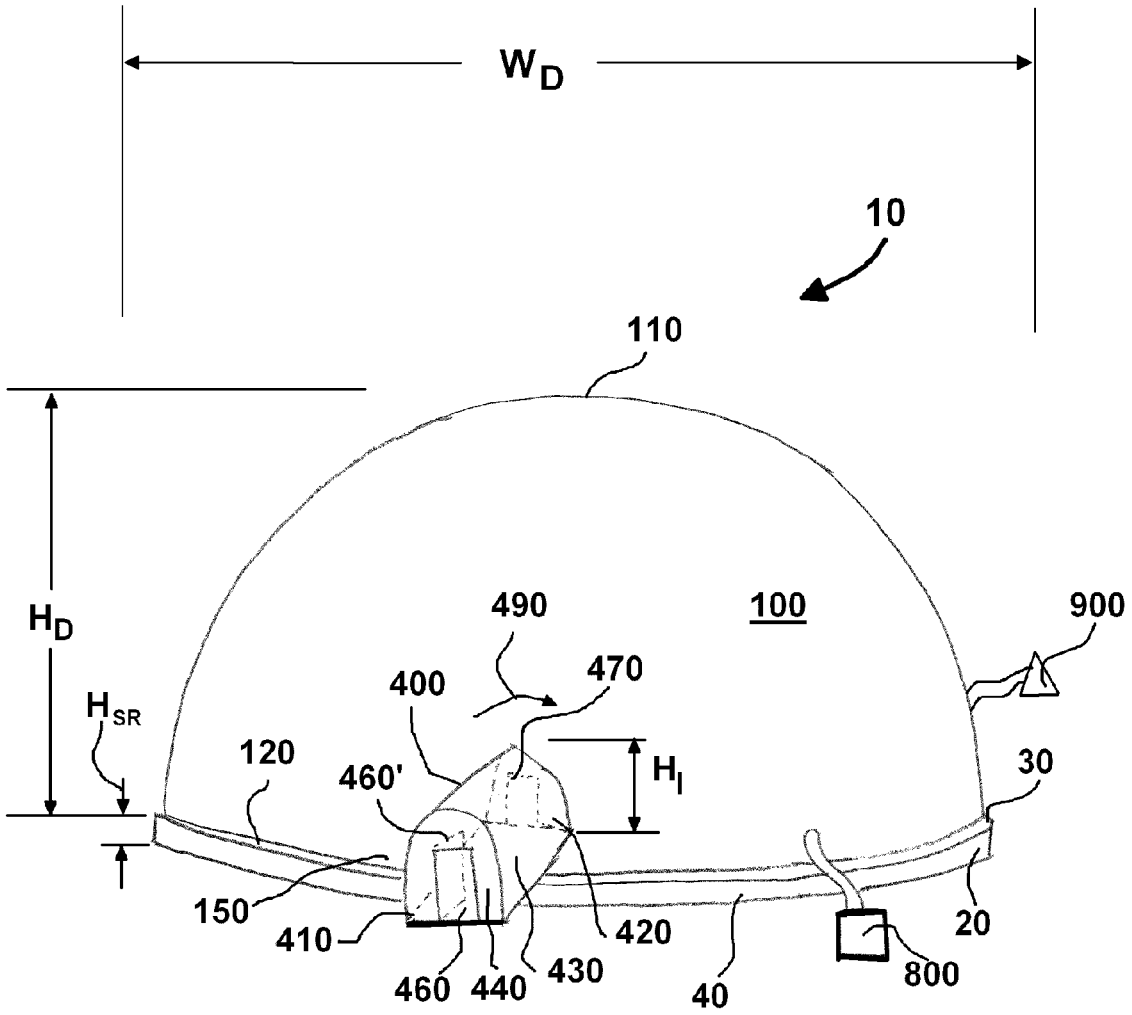
FIG. 1 is a perspective view of the preferred embodiment of the apparatus of the present invention in the form of a dome.
Figure 6:
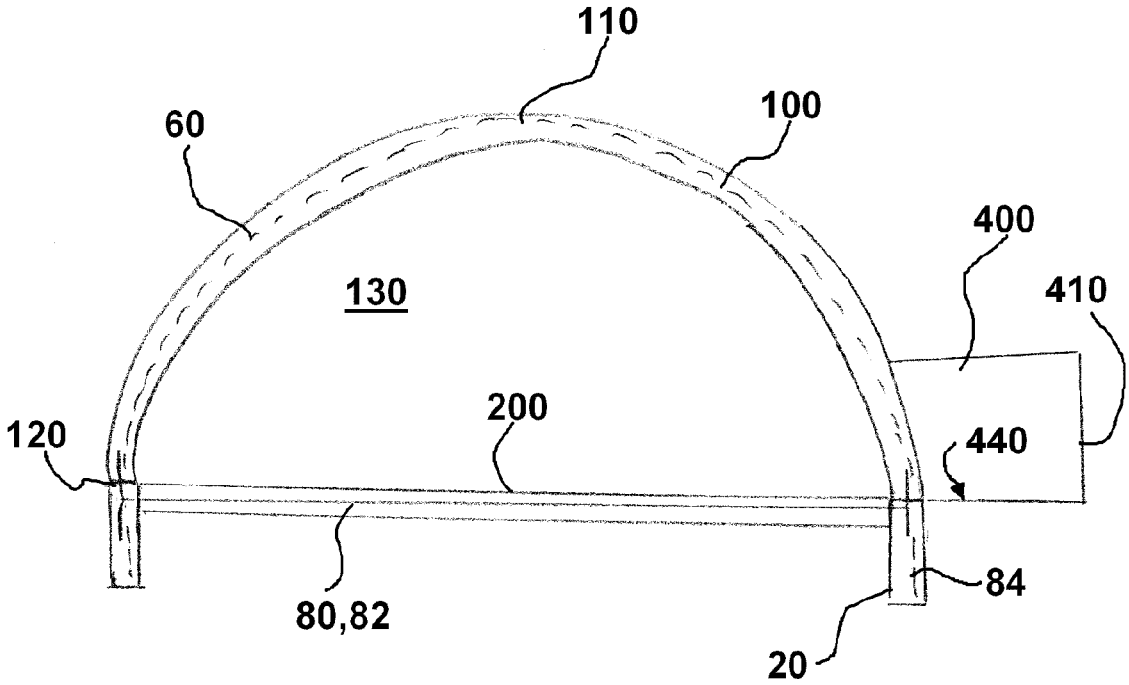
FIG. 6 is a sectional side view of the preferred embodiment of the apparatus of the present invention schematically showing reinforcement in the dome, floor, and support ring portions.

FIGS. 1 and 6 are views of a pressurized facility 10 in the shape of a dome 100. Pressurized facility 10 can comprise dome 100 having interior 130, front 150, rear 140, floor 200, and support ring 20. To pressurize interior 130 a pressurizing system 800 (which is described below) can be provided. A venting system 900 can also be provided. To enter and exit facility 10 an entrance 400 can be provided (see FIG. 2). Entrance 400 can comprise first side 410, second side 420, floor 440, walls 450, and interior 430 (between first and second sides 410, 420).

On first side 410 can be door 460 which can open to the interior 430 of entrance 400 as schematically indicated by arrow 530. Opening to interior 430 provides a fail safe mode as the pressure in interior 430 should consistently be greater than (or at least equal to) ambient pressure outside of entrance 400. Around door 460 can be a sealing system as described below.

On second side 420 can be door 470 which can open to the interior 130 of dome 100 as schematically indicated by arrow 540. Opening to interior 130 provides a fail safe mode as the pressure in interior 130 should consistently be greater than (or at least equal to) pressure of interior 430 of entrance 400. Around door 470 can be a sealing system as described below.

Figure 2:
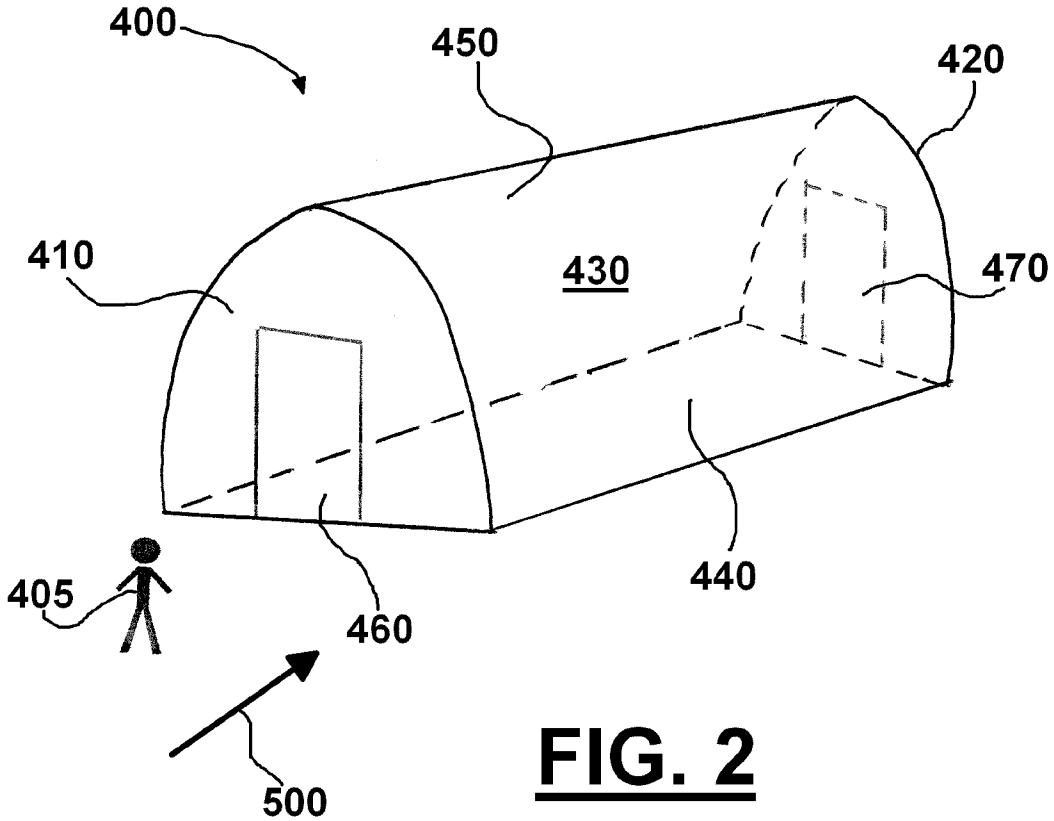
FIG. 2 is a perspective view of the preferred embodiment of the apparatus of the present invention showing an individual entering a dome through a double air lock system.
Figure 3:
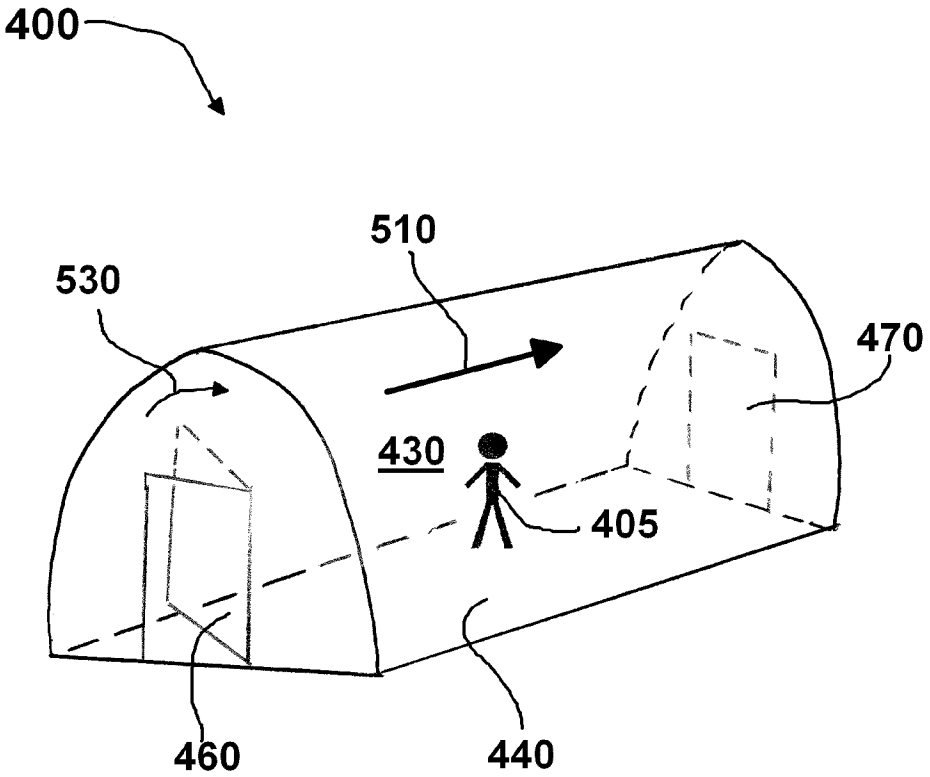
FIG. 3 is a perspective view of the preferred embodiment of the apparatus of the present invention showing an individual entering a dome through a double air lock system.
Figure 4:
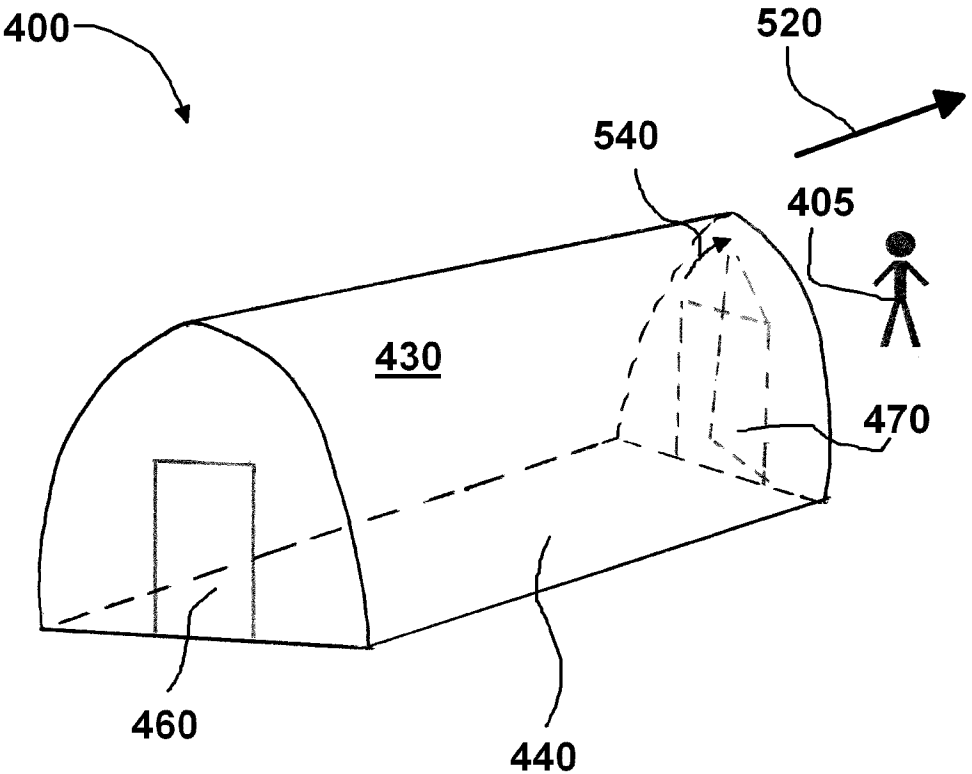
FIG. 4 is a perspective view of the preferred embodiment of the apparatus of the present invention showing an individual entering a dome through a double air lock system.

In one embodiment a double air lock is used to resist excessive pressure loss to interior 130 of dome 100 when individuals enter and exit facility 10. FIGS. 2, 3, and 4 are perspective views of the steps of an individual 405 entering a pressurized facility 10 as schematically indicated by arrow 500 through entrance 400 having a double air lock system (e.g., sealed doors 460, 470).

In one embodiment equalization options are provided to the person 405 entering and/or exiting the double type air lock. The double type air lock can include first sealed lock, an interior space, and a second sealed lock. The first sealed lock can be the transition point between the outside and the interior space. The second sealed lock can be the transition point between the interior space and the interior of the hyperbaric facility.

The hyperbaric facility 10 will be at a higher pressure than the surrounding outside environment. Accordingly, it is preferred to have a system to reduce the transient pressure change when entering and exiting the hyperbaric facility. This can be done through increasing or decreasing relatively slowly the pressure in the interior space relative to the pressure the individual 405 will see when moving from the interior space to either the outside (outside pressure being assumed to be at 1 atmosphere which will be lower than the initial pressure of the interior space) or to the interior of the hyperbaric facility (which interior facility pressure will be higher than the pressure of the interior space) as schematically indicated by arrows 510, 520.

To avoid having the individual 405 see a sharp increase or decrease of pressure, a timed increase or decrease in the interior space is envisioned. This timed decrease of pressure can be obtained through slowly venting the interior space to the outside until the interior pressure equals that of the outside. This timed increase of pressure can be obtained by slowing venting interior pressure of the facility into the interior space until the pressure of the interior space equals the pressure of the interior of the facility. Possible venting systems can include properly sized orifice which can be opened and closed, for example using a valve (ball, gate, butterfly, etc.) where the individual 405 can open the valve to equalize the pressure and then close the valve.

Figure 5:
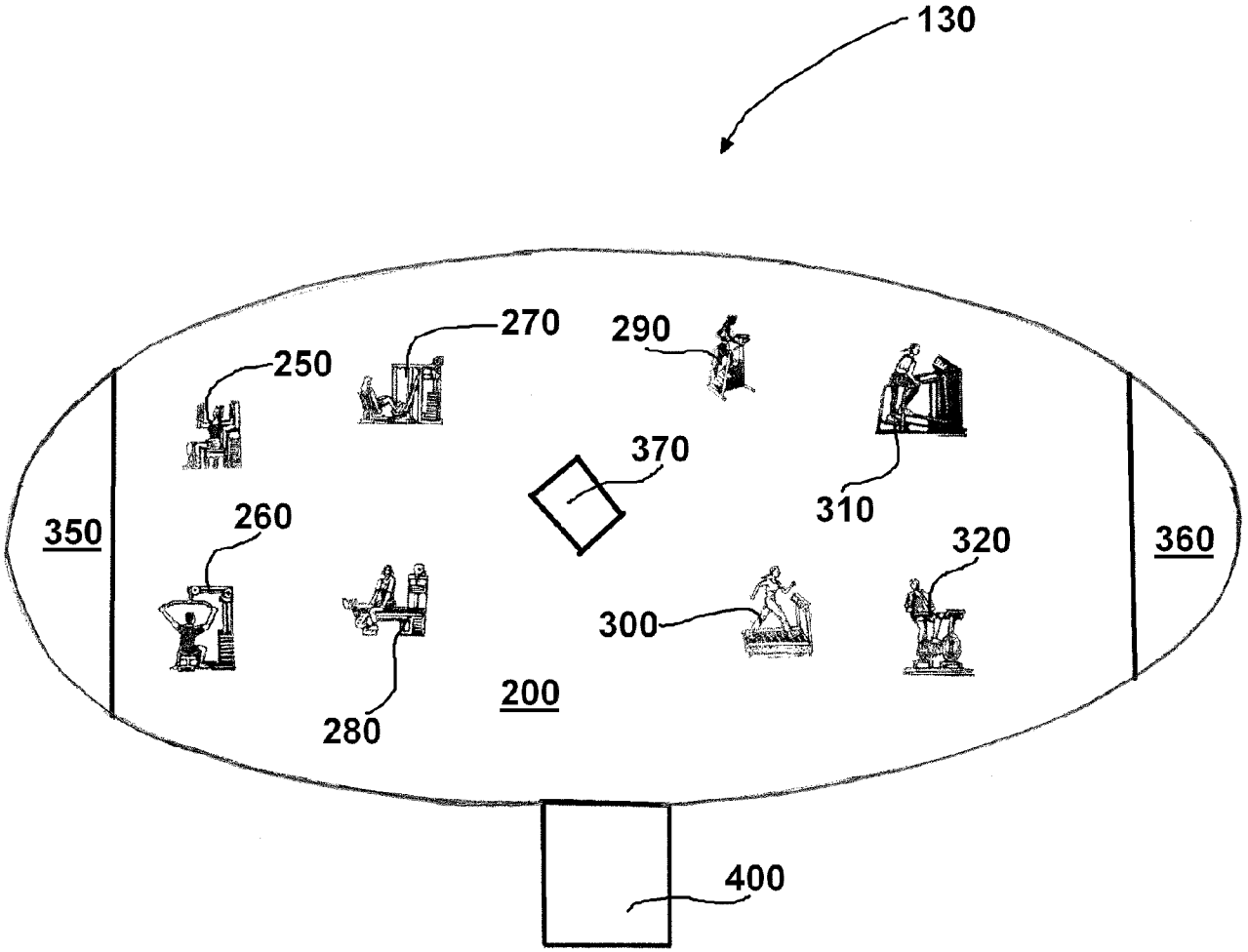
FIG. 5 is a partial top view of the preferred embodiment of the apparatus of the present invention showing the training floor.

In one embodiment, a pressurized exercise facility can be provided in apparatus 10 which includes dome 100. FIG. 5 is a top view of the training floor 200 which can include various exercise equipment along with other facilities. For example, machines 250 (butterflies), 260 (pulls), 270 (leg press), 280 (leg curls), 290 (climber/stepper), 300 (treadmill), 310 (climber/stepper) and 320 (elliptical trainer) can be included. Additionally, free weight stations can be included along with other exercise equipment found in gyms. The training floor 200 can also be an oxygen station 370 that can be located in the center of the floor 200.

In one embodiment there can be included a message center in interior 130 which includes at least one message table. In one embodiment a plurality of message centers are provided. In one embodiment each message center includes a plurality of message tables. In one embodiment one or more saunas 350, 360 (e.g. infrared saunas) are provided. These saunas 350, 360 can be used to various treatment schemes such as removal of various environmental toxins, deep tissue regeneration, and various other items.

Figure 7:
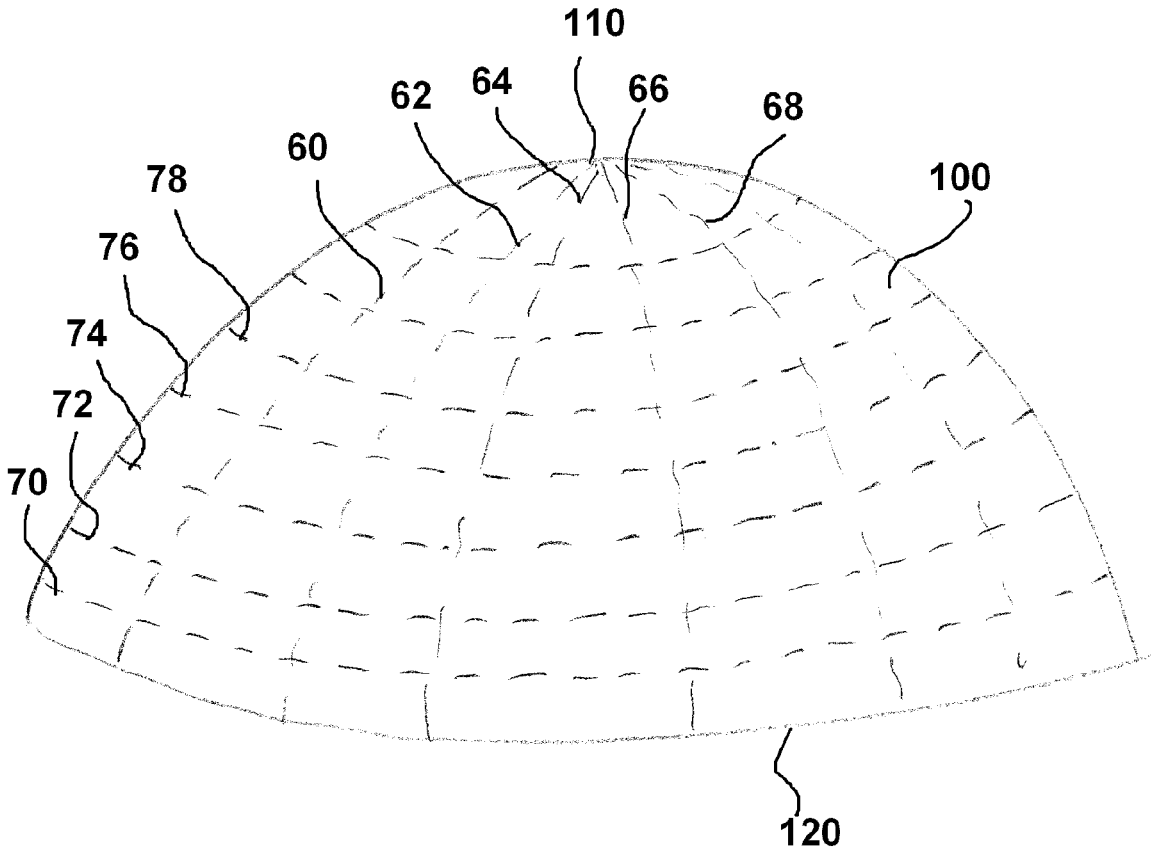
FIG. 7 is a perspective view of the dome schematically showing both longitudinal and latitudinal reinforcement.
Figure 8:
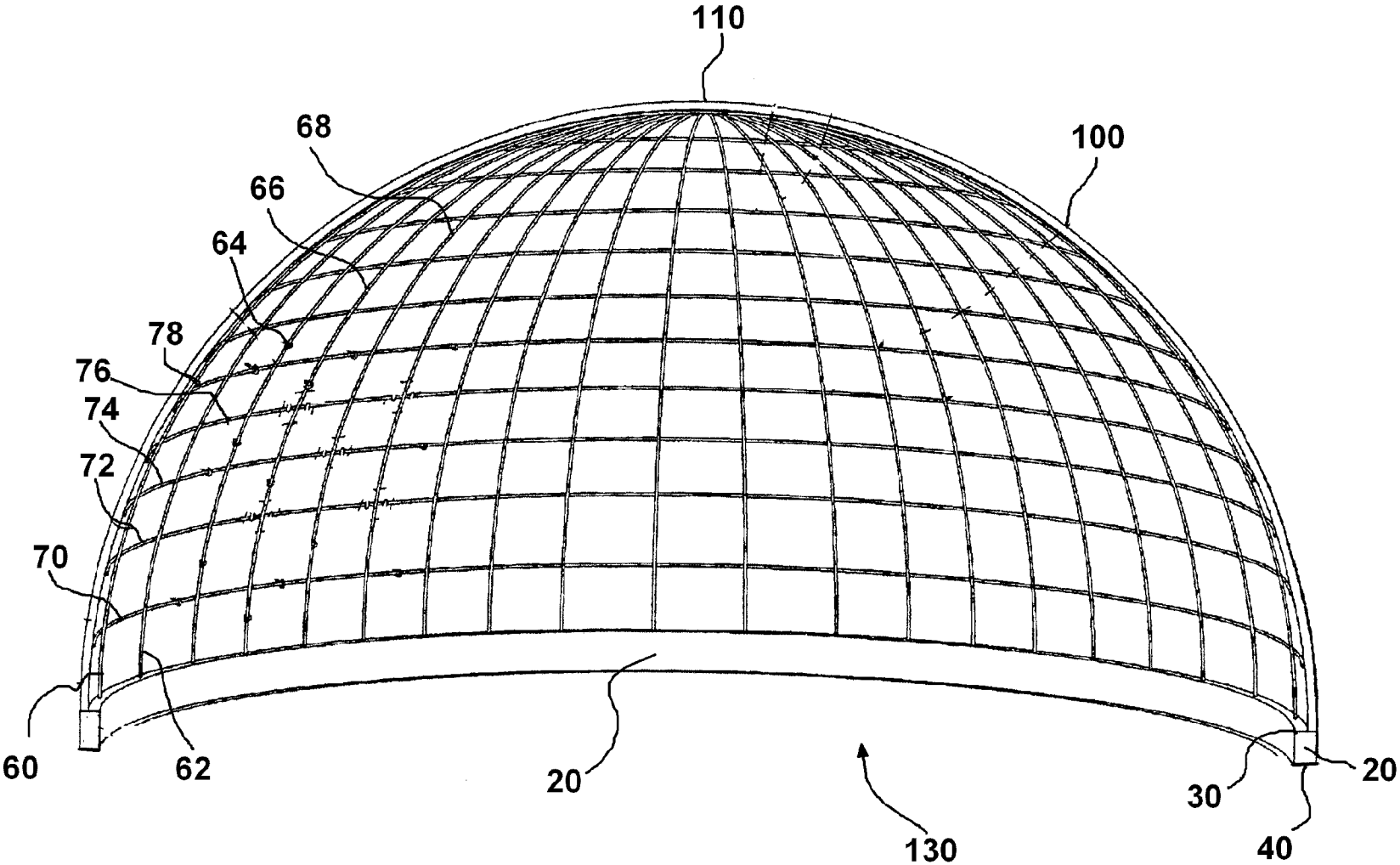
FIG. 8 is a sectional perspective view of the preferred embodiment of the apparatus of the present invention showing both longitudinal and latitudinal reinforcement.
Figure 10:
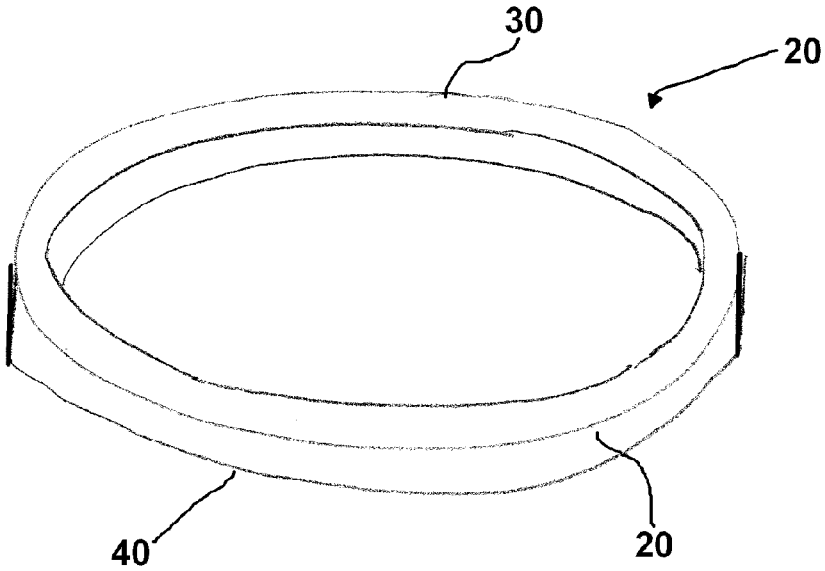
FIG. 10 is a top view of the ring.
Figure 9:
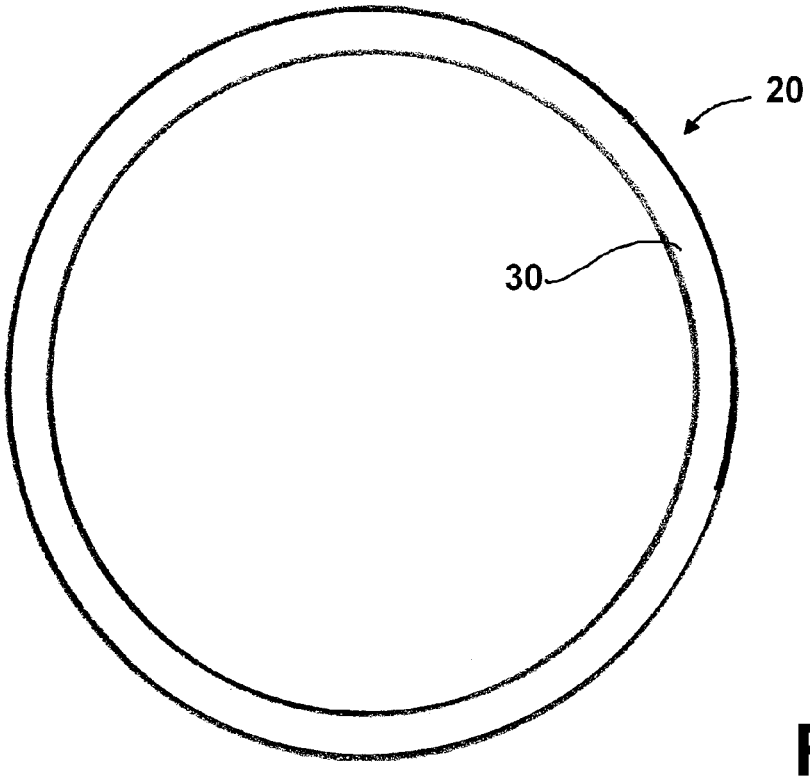
FIG. 9 is a perspective view of the preferred embodiment of the apparatus of the present invention showing the supporting dome ring.

Below will be described the construction of a typical dome 100. Pressurized facility 10 can comprise dome 100 having interior 130, floor 200, and support ring 20. FIG. 6 is a sectional side view of dome 100 schematically showing reinforcement in the dome 100 portion, top 110 portion, floor 200 portion, bottom 120 portion, and support ring 20 portion. FIG. 7 is a perspective view of dome 100 schematically showing both longitudinal 60, 62, 64, 66, and 68 and latitudinal 70, 72, 74, 76, and 78 reinforcement. FIG. 8 is a sectional perspective view of dome 100 (taken through FIG. 7) showing both longitudinal and latitudinal reinforcement. FIG. 9 is a top view of supporting dome ring 20, having a top 30 and a bottom 40. FIG. 10 is a perspective view of ring 20.

Dome 100 can include a plurality of reinforcement, which can be both in a latitudinal direction along with a longitudinal direction. In one embodiment the reinforcement can be pretensioned. In one embodiment the reinforcement can be post tensioned. Support ring 20 can be connected to dome 100 by interlocking reinforcement. Interlocking should be developed to prevent dome portion 100 from being lifted up if its interior 130 pressure increases substantially above ambient pressure. In one embodiment floor 200 can be connected to dome 100 by interlocking reinforcement. In one embodiment floor 200 can be connected to support ring 20 by interlocking reinforcement. In one embodiment floor 200 can be connected to both dome 100 and support ring 20 by interlocking reinforcement.

Figure 11:
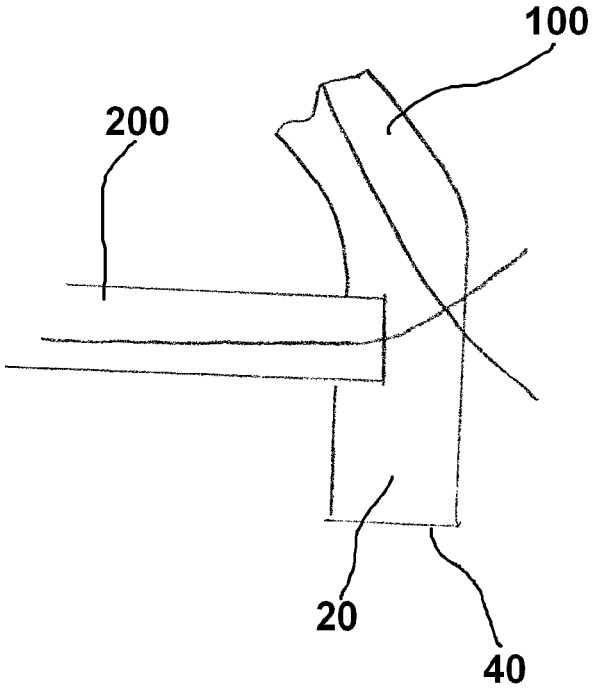
FIG. 11 is a sectional view of the preferred embodiment of the apparatus of the present invention showing the connection between the dome and the support ring with interconnecting reinforcement.
Figure 12:
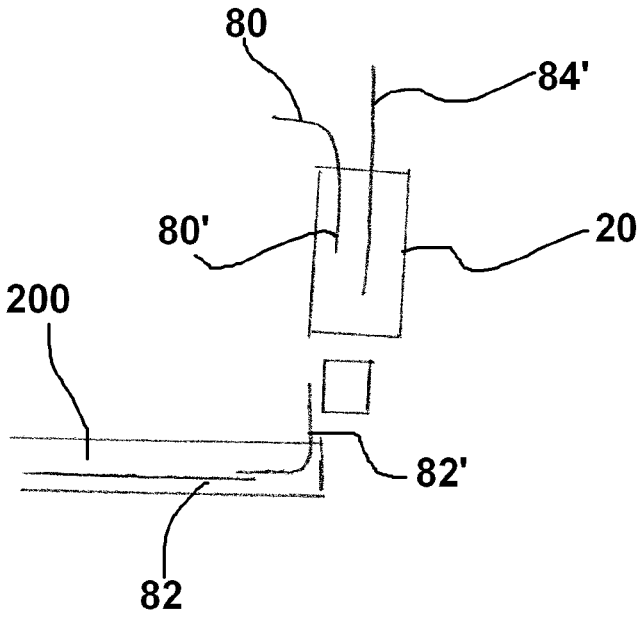
FIG. 12 is another sectional view of the preferred embodiment of the apparatus of the present invention showing the dome and support ring with reinforcement.

FIG. 11 is a sectional view of the connection between dome 100 and support ring 20 with interconnecting reinforcement. FIG. 12 is another sectional view (exploded) of dome 100 and support ring 20 with reinforcement. Reinforcement shown includes 82, 82', 80, 80', and 84'.

Figure 13:
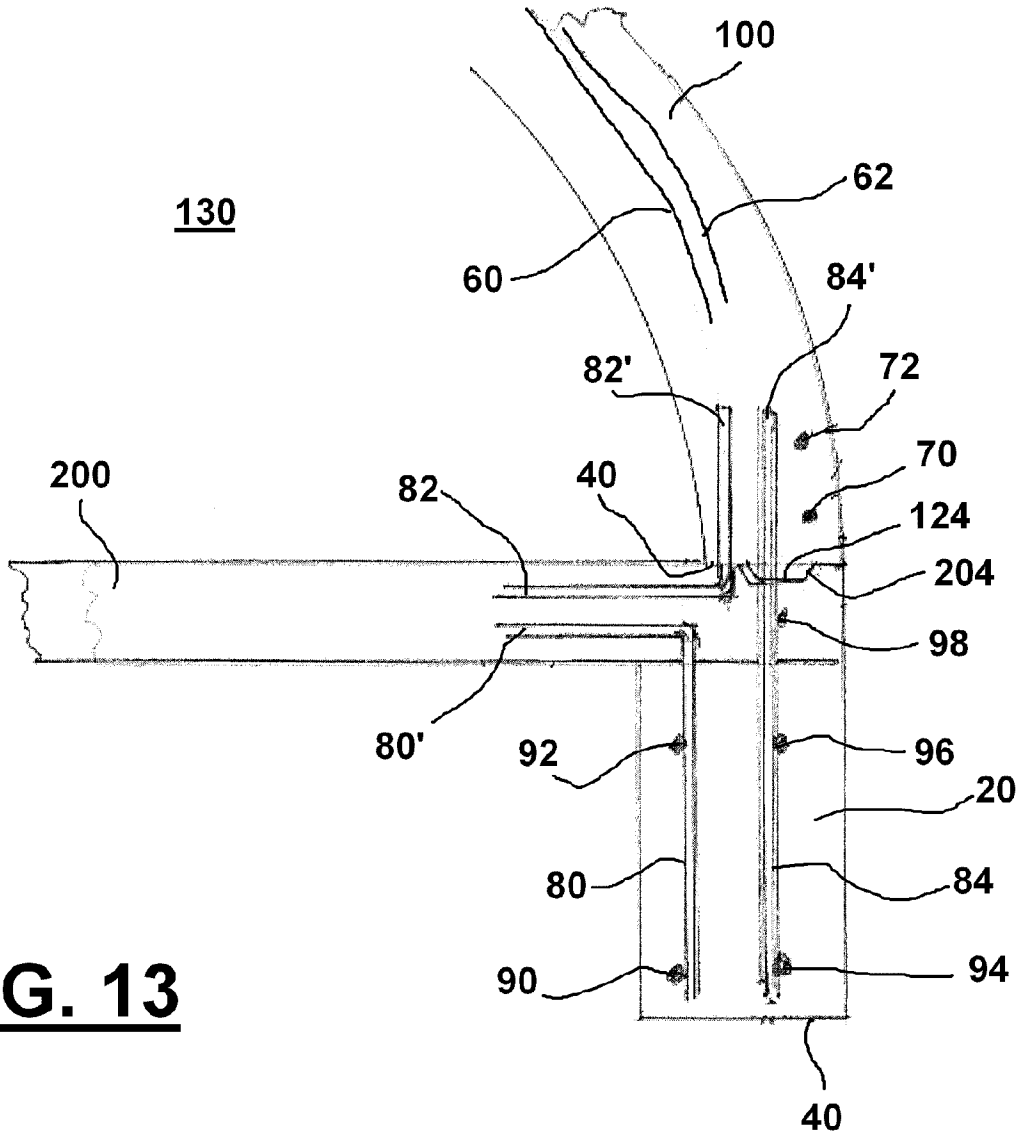
FIG. 13 is a sectional view of the preferred embodiment of the apparatus of the present invention showing dome and support ring with reinforcement.

FIG. 13 is a sectional view of dome 100 and support ring 20 with reinforcement in the form of reinforcing bars or "rebar". Support ring 20 includes horizontal rebars 90, 92, 94, 96, and 98 which can circumnavigate the extent of support ring 20. Support ring 20 can also include a plurality of vertically connecting rebars 90 which can interconnect with rebars in floor 200 (via portion 80'). Plurality of vertically connecting rebars 90 can be symmetrically spaced about support ring 20. Support ring 20 can also include a plurality of vertically connecting rebars 84 which can interconnect with rebars in dome 100 (via portion 84'). Plurality of vertically connecting rebars 84 can be symmetrically spaced about support ring 20.

Dome 100 can include a plurality of longitudinal reinforcing bars or "rebars" 60, 62, 64, 66, 68 which circumnavigate dome 100. These plurality of longitudinal rebars can be interconnected with plurality of vertical rebars 84 in support ring 20. These plurality of longitudinal rebars can be interconnected with plurality of horizontal rebars 82 (via vertical portions 82') in floor 200. Plurality of horizontal rebars can be of a spoke formation and symmetrically spaced about floor 200.

Dome 100 can also include a perimeter rib 124. Floor 200 can also include a perimeter groove 204. Perimeter rib 124 can fit inside perimeter groove 204. In one embodiment dome 100 can be directly connected to support ring 20. Support ring 20 could have perimeter groove 204', and floor 200 can abut the interior of support ring 20. However, even in this embodiment it is preferred that all three items (dome 100, floor 200, and support ring 20) be interconnected.

Figure 14:
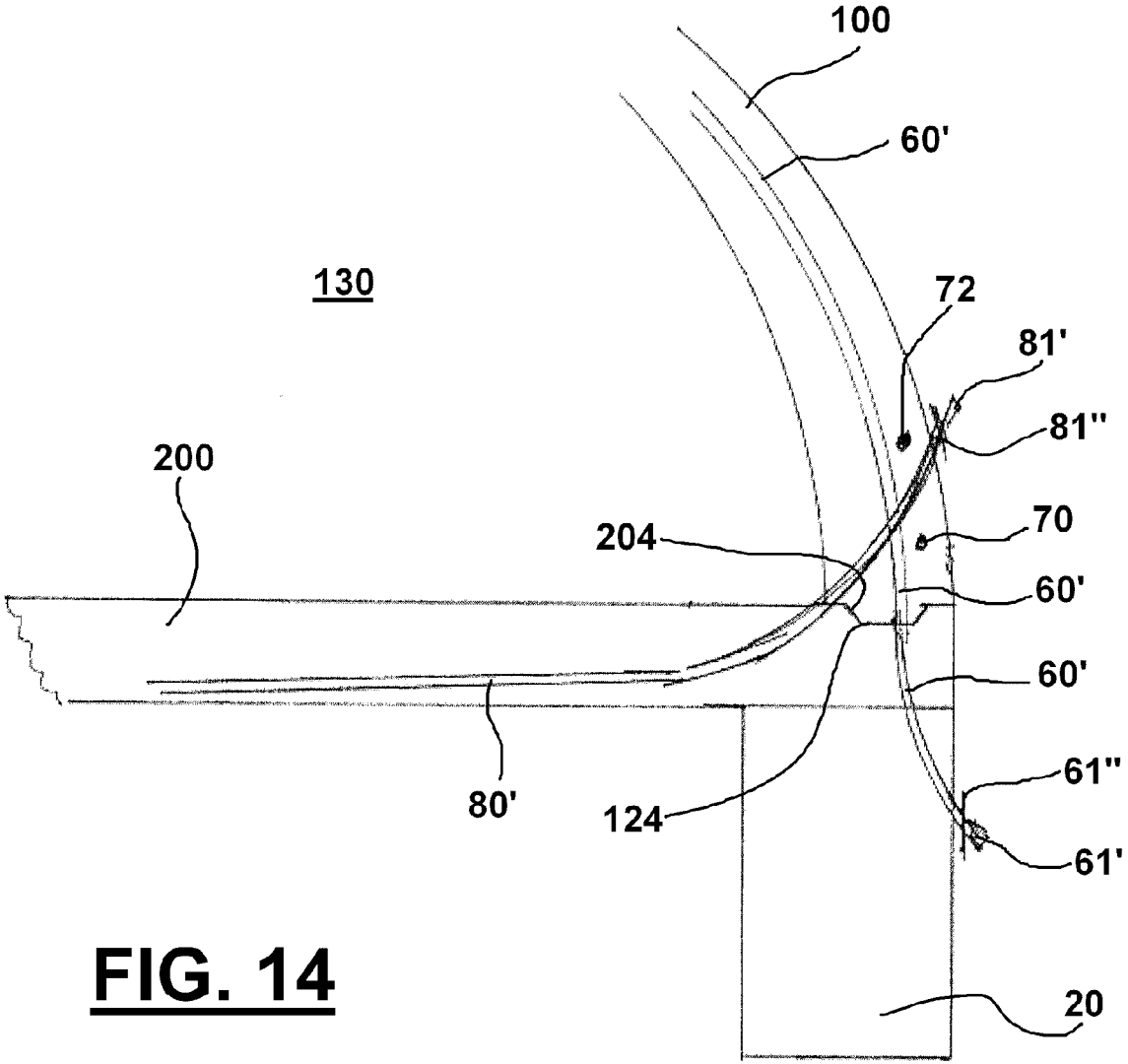
FIG. 14 is another section view of the preferred embodiment of the apparatus of the present invention showing dome and support ring with reinforcement.

FIG. 14 is another section view of dome 100 and support ring 20 with reinforcement in the form of prestressed reinforcement. Although not shown for clarity, support ring 20 can includes horizontal reinforcement 90, 92, 94, and 96 which can circumnavigate the extent of support ring 20. This horizontal reinforcement can be post tensioned to reduce the tensile load on support ring 20. Support ring 20 can also include a plurality of vertically connecting reinforcement 60 which can interconnect with reinforcement 80' in floor 200 (via portion 80'). These reinforcement can be post tensioned reinforcement. Plurality of vertically connecting reinforcement 60 can be symmetrically spaced about support ring 20. Support ring 20 can also include a plurality of vertically connecting reinforcement 60' which can interconnect (or be one continuous piece of reinforcement) with reinforcement in dome 100. Plurality of vertically connecting reinforcement 60' can be symmetrically spaced about support ring 20.

Dome 100 can include a plurality of longitudinal post tensioned reinforcement 60, 62, 64, etc. which circumnavigate dome 100. These plurality of longitudinal reinforcement can be interconnected with post tensioned reinforcement in support ring 20. These plurality of post tensioned longitudinal reinforcement can be interconnected with plurality of post tensioned reinforcement in floor 200. Plurality of horizontal post tensioned reinforcement can be of a spoke formation and symmetrically spaced about floor 200.

Dome 100 can also include a perimeter rib 124. Floor 200 can also include a perimeter groove 204. Perimeter rib 124 can fit inside perimeter groove 204. In one embodiment dome 100 can be directly connected to support ring 20—here support ring 20 could have perimeter groove 204', and floor 200 can abut the interior of support ring 20. However, even in this embodiment it is preferred that all three items (dome 100, floor 200, and support ring 20) be interconnected.

Using a dome made of sprayed concrete or shotcrete can dramatically reduce the cost of constructing the hyperbaric facility. This also allows a dramatic increase in the overall size the dome over conventionally available hyperbaric chambers. For example, domes having diameters ranging between about 20 feet to 1000 feet in diameter can be used; more preferably between about 30 feet to 900 feet, more preferably between about 40 feet to 800 feet, more preferably between about 50 feet to 700 feet. Additionally, domes having diameters of at least about 50, 60, 70, 80, 90, 100, 125, 150, 175, 200, 250, 300, 350, 400, 450, 500, 600, 700, 800, 900, and 1000 feet can be used. Alternatively, ranges of diameters of domes between about any of the two above specified diameters can be used.

In one embodiment the interior of the facility is maintained at a pressure of between about 1.2 to 2.4 atmospheres absolute of pressure in the interior to provide a hyperbaric situation (assuming 1.0 atm=14.7 psi at standard temperature at sea level); more preferably between about 1.2 to 2.0; more preferably between about 1.2 to 1.8; more preferably between about 1.2 to 1.6; more preferably between about 1.2 to 1.4, more preferably, between about 1.2 to 1.3; and most preferably about 1.3. Alternatively, ranges of pressures between about any of the two above specified pressures can be used. Alternatively, pressure can be maintained between about 1.3 to 1.4 atmospheres. Alternatively, pressures between about 1.4 to 2.4, more preferably between about 1.6 to 2.4, and more preferably between about 1.8 to 2.4. Alternatively, ranges of pressures between about any of the two above specified pressures can be used.

The hyperbaric chamber devices of the invention are designed to maintain pressure from 0-20 psi above ambient. In other embodiments the pressure range can be 3, 4, 5, 6, 7, 8, 9, 10, 11, 12, 13, 14, 15, 16, 17, 18, 19, and/or 20 psi above ambient. Alternatively, ranges of pressures between about any of the two above specified pressures can be used.

Figure 15:
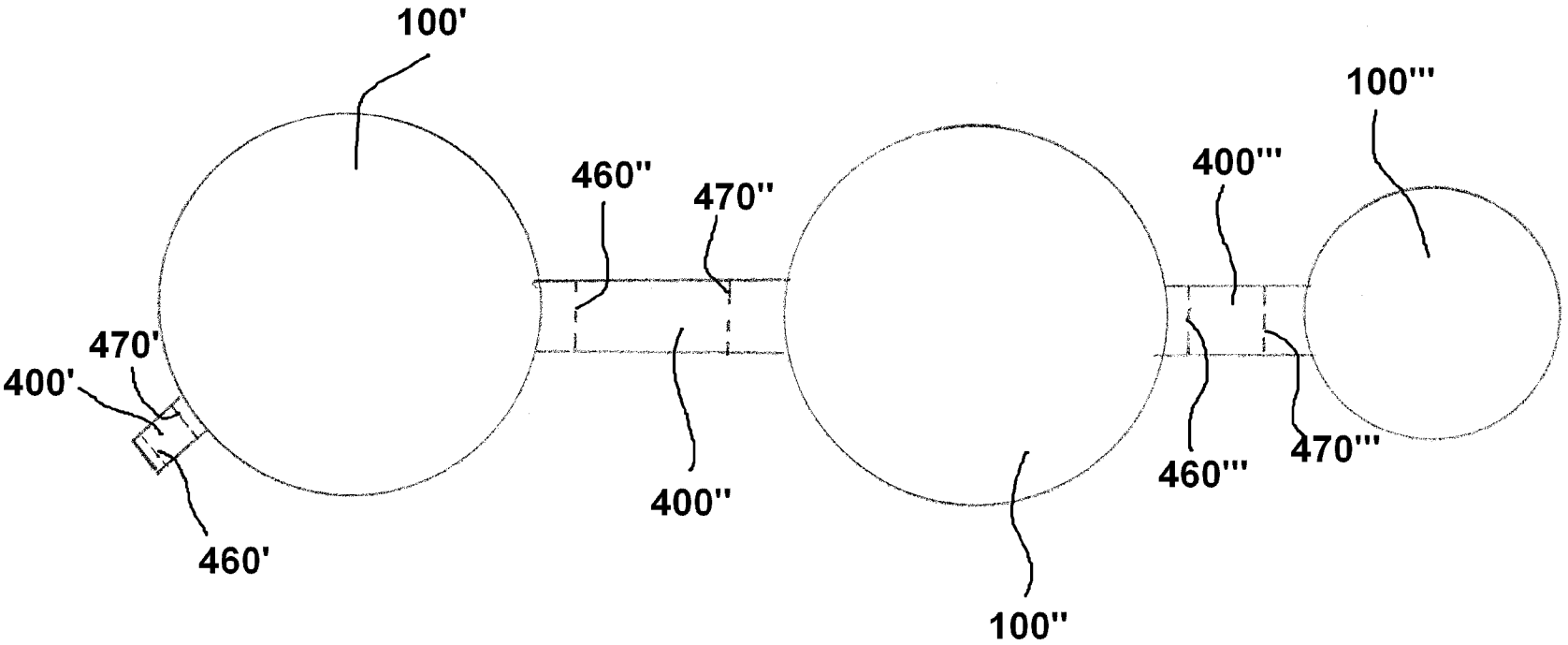
FIG. 15 is a top schematic view of the preferred embodiment of the apparatus of the present invention for a multi-dome configuration.

FIG. 15 is a top schematic view of a multi-dome configuration for a pressurized facility. The multi-dome configuration can include domes 100', 100", and 100'". Entrance 400' can be attached to dome 100'. Entrance 400' can be a double air lock with doors 460' and 470'. Entrance 400" can connect domes 100' and 100". Entrance 400" can be a double air lock with doors 460" and 470". Entrance 400'" can connect domes 100" and 100'". Entrance 400'" can be a double air lock with doors 460'" and 470'". Each of the domes 100', 100", and 100'" can include exercise facilities. In one embodiment different themes can be provided for each of the domes. For example, in dome 100' exercise machines can be provided, while in dome 100" saunas can be provided, while in dome 100'" a rest and relaxation environment can be provided.

Although a semicircular shape is preferred for the dome (e.g., having a semicircular cross section and constant radius of curvature) embodying a hemisphere of a sphere, variations of the radius of curvature are envisioned. For example, a cross section of the dome can have the ratio of the radius of curvature (at an angle of inclination from the horizontal of 90 degrees) compared to the radius of curvature (at an angle of inclination from the horizontal of 0 degrees) varying between about 8/16 to 16/16; about 9/16 to 15/16, about 10/16 to 14/16, about 11/16 to 13/16, and 12/16. Alternatively, ranges between about any of the two above specified ratios can be used. For example, at a ratio of 8/16 the height of the dome (H) would be the one fourth of the length of the base (D).

As another example, a cross section of the dome can have the ratio of the radius of curvature (at an angle of inclination from the horizontal of 90 degrees) compared to the radius of curvature (at an angle of inclination from the horizontal of 0 degrees) varying between about 32/16 to 16/16; about 30/16 to 18/16, about 28/16 to 20/16, about 26/16 to 22/16, and 24/16. Alternatively, ranges between about any of the two above specified ratios can be used. For example, at a ratio of 24/16 the height of the dome (H) would be the same as the length of the base (D).

Figure 16:
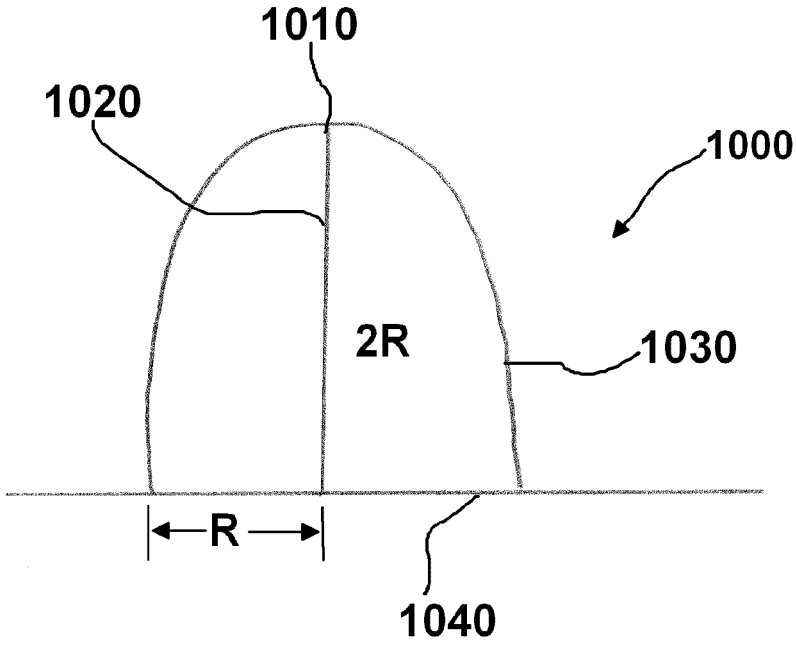
FIG. 16 shows a cross section of the preferred embodiment of the apparatus of the present invention showing a parabolic shape where the maximum height is larger than the radius of the circular base.

FIG. 16 shows a dome cross section 1000 having a parabolic shape with the maximum height of the top 1010 being larger than the radius of the circular base. Dome 1000 can have top 1010, side 1030, and bottom 1040. At top 1010 is height 1020. In this example height 1020 (2R) is equal to the width of dome 1000 at bottom 1040.

Figure 17:
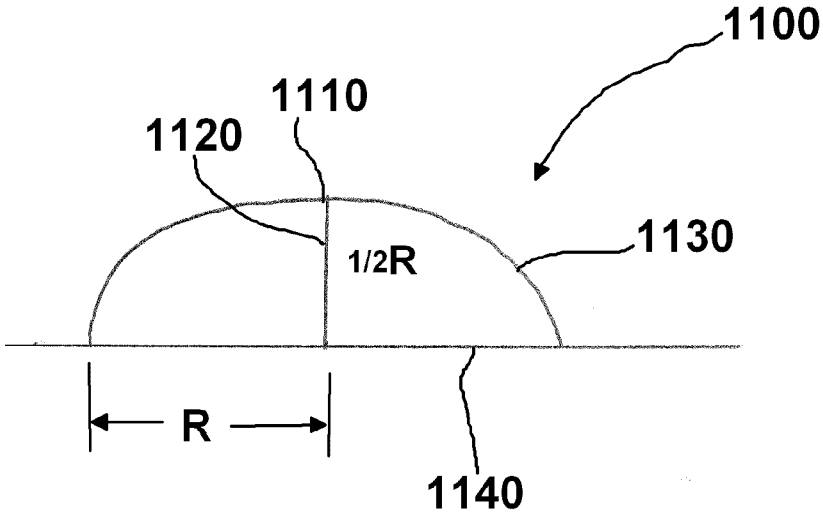
FIG. 17 shows a cross section of the preferred embodiment of the apparatus of the present invention having a parabolic shape where the maximum height is smaller than the radius of the circular base.

FIG. 17 shows a dome 1100 having a parabolic shape with the maximum height of the top 1110 being smaller than the radius of the circular base. Dome 1100 can have top 1110, side 1130, and bottom 1140. At top 1110 is height 1120. In this example height 1120 (½R) is equal to one fourth of the width of dome 1100 at bottom 1140.

Figure 18:
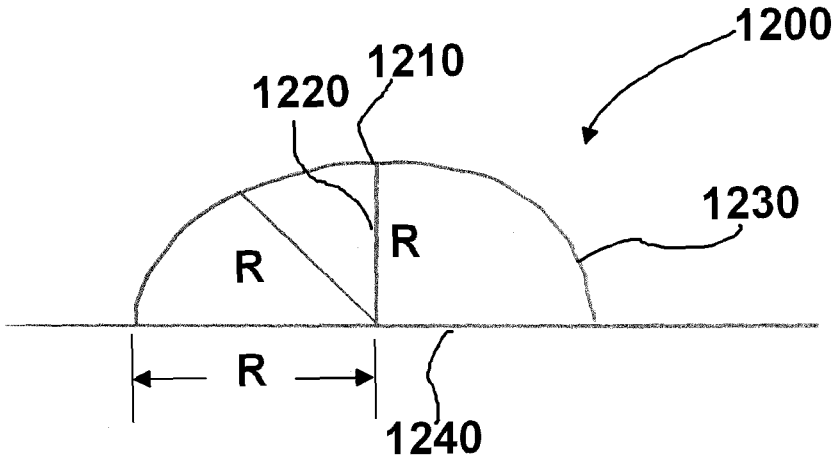
FIG. 18 shows a dome cross section of semi-circular shape.

FIG. 18 shows a dome 1200 cross section having a semicircular shape. Dome 1200 can have top 1210, side 1230, and bottom 1240. At top 1210 is height 1220. In this example height 1220 (R) is equal to one half of the width of dome 1200 at bottom 1240.

Figure 19:
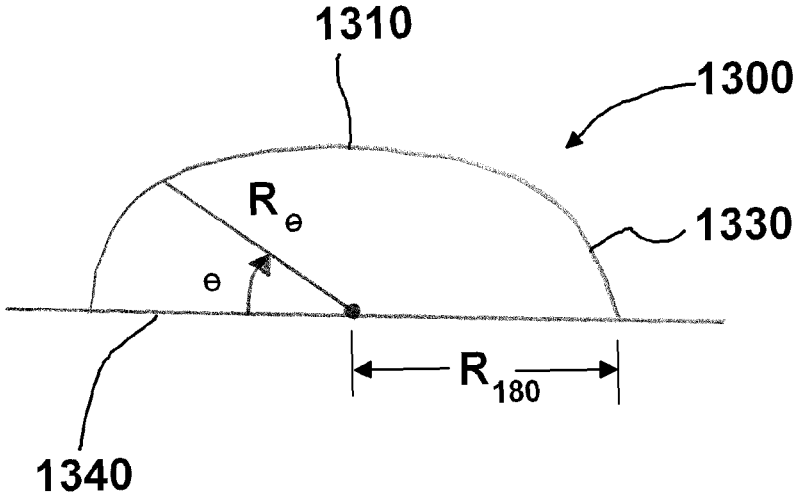
FIG. 19 shows a dome cross section having a shape with its radius of curvature varying at predefined rates.

FIG. 19 shows a dome 1300 cross section having a shape with its radius of curvature varying at predefined rates—being a function of its angle Theta. Dome 1300 can have top 1310, side 1330, and bottom 1340.

In one embodiment a tension ring can be provided at the base of the structure to resist/absorb expansive stresses of the dome.

In one embodiment, the interior of the facility includes an increased percentage of oxygen compared to ambient oxygen found at ambient pressures and sea level.

In one embodiment, as an alternative to increasing the percentage of oxygen in the interior (compared to ambient oxygen found at ambient pressures and sea level) the interior of the facility is provided with one or more high concentration oxygen sources. Enhanced $O_2$ can be provided to interior occupants and can be provided via hoses attached to hood, mask, nasal tubing, or canula delivering $O_2$ from bottles or oxygen concentrator, at pressures slightly, modestly, and/or highly elevated over internal chamber pressure.

In one embodiment aerobic exercise can be performed within chamber for enhanced oxygenation of tissues and detoxification of tissues.

Many suitable means for introducing air or gas mixtures to achieve a desired pressure are known in the art. The choice thereof will depend on the use to be made of the device, the volume of air to be delivered and the desired rate of circulation. Other considerations, such as temperature, humidity and noise level are also significant. For an exerciser, where a larger volume must be filled, an electric or gas-powered compressor can be used. Where a constant air flow at preset pressure is desired, a differential pressure gauge with an exhaust valve may be included. Other means, including supplying air or gas from a pressurized tank may be used, as will be understood by those of ordinary skill in the art. It will also be understood that positive displacement pumping means are required because fans, blowers and the like are not capable of providing the desired range of pressures.

The internal atmospheric composition can be controlled by means known to the art. As examples without any limitation of such means, known expedients for scavenging $CO_2$ and humidity may be employed, the capacity of such means being provided according to the intended use of the devices. The mountain bubble, enclosing a resting individual, can contain such $CO_2$ and humidity control as required using portable scavenging materials known in the art. The exerciser devices require larger capacities according to the needs of an exercising person. Alternatively, the exerciser can be provided with a sufficient flow of input air or gas mixture that the device is essentially continuously purged of excess $CO_2$ and humidity. Inasmuch as such means are peripheral to the basic devices, substitutions may be made as desired without the necessity of making major changes to the device itself, all within the scope of ordinary skill as presently known or later devised, according to the desired and intended function of the device.

Temperature can be controlled, where needed, by conventional means external to the devices themselves. In the exerciser, cooling is the more likely requirement accomplished, for example, by passing input air over the cooling coils of an air conditioning unit.

Entrances and exits to the dome can be designed to minimize any pressure loss to the interior of the facility when individuals enter and exit the facility. A double type air lock is envisioned. In one embodiment this double type air lock can comprise a pair of spaced apart hinged doors which open to the interior of the facility, the doors being placed in a pressure rated corridor. Preferably, each door swings open toward the interior of the facility. In one embodiment the doors can be automated where they automatically open and close. In one embodiment the doors can be manually opened and closed.

Each door can be pressure rated to the design pressure of the facility. Each door should have a seal around its perimeter where the interior pressure will push against the door and increase the effectiveness of the seal. One example seal can be foam rubber or neoprene rubber. In one embodiment at least one window is placed in each door. In one embodiment, an automatic lock can be activated where the interior pressure is below a set limit at least until the interior pressure raises to the specified limit. In one embodiment the lock is only on the outer door. In one embodiment a warning signal is made when the interior pressure is below a specified minimum so that the person attempting to open the door can decide whether to override the warning signal. In one embodiment the automatic lock can be overridden by the person opening the door.

In one embodiment equalization options are provided to the person entering and/or exiting the double type air lock. The double type air lock can include first sealed lock, an interior space, and a second sealed lock. The first sealed lock can be the transition point between the outside and the interior space. The second sealed lock can be the transition point between the interior space and the interior of the hyperbaric facility. The hyperbaric facility will be at a higher pressure than the outside. Accordingly, it is preferred to have a system to reduce the transient pressure change when entering and exiting the hyperbaric facility. This can be done through increasing or decreasing relatively slowly the pressure in the interior space relative to the pressure the individual will see when moving from the interior space to either the outside (outside pressure being assumed to be at 1 atmosphere which will be lower than the initial pressure of the interior space) or to the interior of the hyperbaric facility (which interior facility pressure will be higher than the pressure of the interior space). To avoid having the individual see a sharp increase or decrease of pressure, a timed increase or decrease in the interior space is envisioned. This timed decrease of pressure can be obtained through slowly venting the interior space to the outside until the interior pressure equals that of the outside. This timed increase of pressure can be obtained by slowing venting interior pressure of the facility into the interior space until the pressure of the interior space equals the pressure of the interior of the facility. Possible venting systems can include properly sized orifice which can be opened and closed (such as a valve—ball, gate, butterfly, etc.) where the individual can open the valve to equalize the pressure and then close the valve. An emergency pressure release can be provided.

Alternatively, the timed venting can be automated by using a plurality of sensors (at the outside, interior space, and interior of the facility), where automatic valves are used and the pressure equalized based on the differences in pressure sensed by the sensors. In one embodiment the timing of opening and closing the doors can be set by the user to open and close in a specified programmed time period.

Alternatively, the doors can be opened slowly to allow this slow venting process.

Alternatively, a second double air lock to the interior of the hyperbaric facility can be provided where one of the double air locks is specified as being the entrance, and the second of the double air locks is specified as being the exit.

In one embodiment, one or more of the doors can be a sliding door which slides open and closed. In the closed position the door seals with conventionally available seals. The sliding doors can be automated or can be manual.

In one embodiment the interior pressure of the hyperbaric facility is maintained at one of the specified levels in this application. The desired elevated pressures can be obtained through the use of one more pumps, compressors, and/or gas filled canisters. Where pumps are used, centrifugal, reciprocating, rotary, vane, piston, blower, screw, double screw, etc. types pumps can be used. Where compressors are, rotary, vane type, blowers, and/or piston type compressors can be used. Additionally, one or more blowers can be used.

One or more redundant systems to increase and/or maintain pressure can be used, such that where one of the primary pressure system fails, a redundant pressure system can be used to maintain the pressure of the interior of the hyperbaric facility.

In one embodiment one or more pressure sensors can be used to measure the interior pressure of the hyperbaric facility and the pressure system runs until the interior pressure reaches a specified minimum. In one embodiment the pressure will turn back on when the interior pressure falls below a specified level. In one embodiment the specified level to cut off the pressure is higher than the specified level to turn on the pressure. In one embodiment the pressure levels are the same.

In one embodiment where gas filled canisters are used. In one embodiment one or more pressure sensors can be used to measure the interior pressure of the hyperbaric facility and the canisters are opened until the interior pressure reaches a specified minimum. In one embodiment the canisters are again opened when the interior pressure falls below a specified level. In one embodiment the specified level to open the canisters is higher than the specified level to close the canisters. In one embodiment the pressure levels are the same.

In one embodiment one or more pressure regulators can be used to ensure that the interior pressure in the facility does not exceed a specified limit. If the pressure exceeds this specified level for whatever reason the regulator opens and bleeds off until a second specified lower limit is achieved.

In one embodiment the interior of the hyperbaric facility includes a climate control system. The climate control system maintains temperature and air quality. It can include conventionally available heating systems (such as steam, hot water, infrared, electric heating, etc.); conventionally available cooling systems, such as a chilled water and brine systems, absorption chillers, centrifugal chillers, cooling towers, and/or gas sorbent systems. Heat transfer can occur through either heated or cooled piping which moves the heated or cooled gases or fluids through the interior of the facility.

Air quality can be achieved and/or maintained by a bleeder valve system to flush "stale" air and/or carbon dioxide. In one embodiment includes conventionally available gas removal systems such as gas absorption systems and/or membrane separation systems. In one embodiment a sensor driven automated gas pressure swing absorption molecular sieve sorbents to selectively remove gases such as carbon dioxide.

In one embodiment one or more closed-circuit rebreathers can be used, such as that described herein and in U.S. Pat. No. 4,974,829, incorporated herein by reference. $CO_2$ produced by the users of the hyperbaric facility can be vented from the interior by means of one or more pressure relief valves. It is believed that continuous ventilation of the interior 42 liter/min, per person occupancy serves both to bring in fresh oxygen and vent out $CO_2$, such that the $O_2$ concentration in the chamber never drops to below 20% and $CO_2$ never reaches a 1% level (2).

In one embodiment, higher CO2 levels of up to 7% can be user programmed to prevent blood vessel restriction resulting from hyperoxia and will initiate dilation of blood vessels, at which levels it is believed the bodies regulatory mechanisms allow more oxygen to cross the blood/brain barrier and thereby provide more oxygen directly to the brain, spinal cord, organs, and capillaries.

In one embodiment one or more closed-circuit rebreathers can be provided which can both remove the $CO_2$ from the exhalant and replace the $O_2$ consumed by the users of the facility. Such devices have been routinely used by divers, firemen and miners. In one embodiment a $CO_2$ scrubber can be used. The scrubber can include a series of one foot square pads that have been impregnated with LiOH. One pad has been determined to last on the order of 20 minutes. The pads function not only to remove the $CO_2$ but also the accumulated moisture. A Matheson, model 8-2, pressure regulator, full scale range 0 to 3 psi, was used to both maintain chamber pressure and to also replace the spent oxygen.

In one embodiment a humidity control system can be used. These can include cold coil and/or desiccant types and can control the latent heat to optimal levels, typically ranging from a low of 40% relative humidity (RH) to a high of 80% RH in order to effectuate various modalities of therapeutics. In one embodiment the humidity control system can be automated, such as a sensor control system, and which can be user programmable in a stepped interval across a diurnal cycle.

In one embodiment a system for removing volatile organic compounds from the interior of the hyperbaric facility can be used. These can include the use of various sorbent systems, such as an activated carbon system. Activated carbons can be used for the adsorption ofmany organic compounds from contaminated water and air streams. The adsorption process results from a physical attraction which holds molecules of the absorbate (e.g., stuff to be removed) at the surface of a solid by the surface tension of the solid.

In one embodiment an oxygen regulatory system can be used to regulate the concentration of oxygen. This can be the partial pressure of oxygen, or by weight or volume percent. The regulatory system can be automated through sensor and computer control. Oxygen can be added through various means such as pressurized gas canisters of pure and/or concentrated oxygen, sieve systems (e.g., molecular sieves), and/or membrane separation systems.

In one embodiment the oxygen level of the interior of the hyperbaric facility can be programmable as to level and timing. For example, the level content can be programmed to change over a set period of time and/or in a specified manner and/or pattern. For example, the oxygen level can follow a sinusoidal pattern, or a ramped pattern, or a stepped pattern over time so that when extra physical activities are performed extra oxygen can be available for such physical activities. This can be programmable over time and pattern, such as during set times during the day, or set days during the week. In one embodiment, the number of individuals occupying the interior can determine which of the available patterns will be selected. It is believed that varying the level of oxygen in different set patterns can increase the efficacy of exercising and/or physical activities performed in the interior of the facility. In one embodiment the level of oxygen in the interior can vary between a low of 21 percent to a high of 42 percent based on partial pressures.

Figure 20:
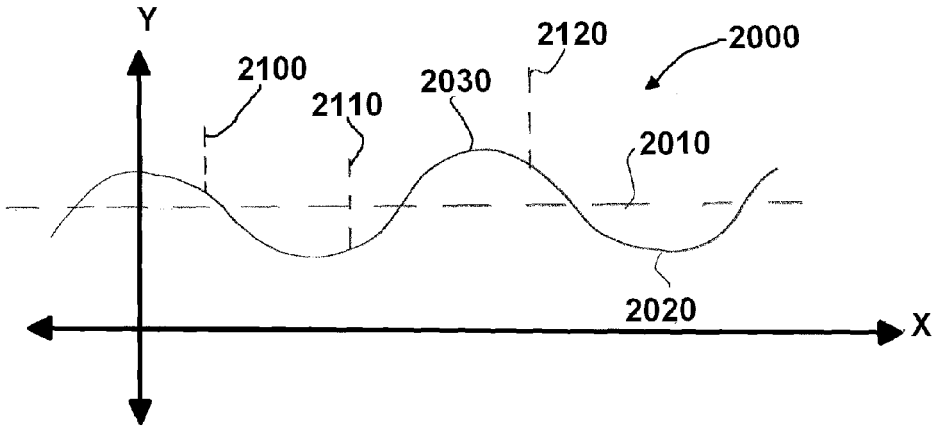
FIG. 20 shows a sinusoidal function example of various inputs during therapy.

FIG. 20 shows a sinusoidal function 2000 example of various inputs during therapy. Here, the oxygen level in the interior 130 of dome 100 can vary as set forth in function 200. Alternatively, pressure can vary as set forth in function 2000. An average value 2010 of the varying input can be maintained even though the transient value will change over time. In FIG. 20 the X axis measures time and the Y axis measures amount of the varied item (e.g., oxygen level, pressure, etc.). The varying input function has a lower value 2020, wavelength 2040, period 2050. At selected times changes in activity can occur—e.g., at time 2110 exercise can begin where oxygen levels start increasing, at time 2120 exercise can be stopped. Alternatively, the function 2000 can be programmable for period 2050, wavelength 2040, amplitude 2030, and average value 2010 by attendants of facility 10, or by users of facility 10.

Figure 21:
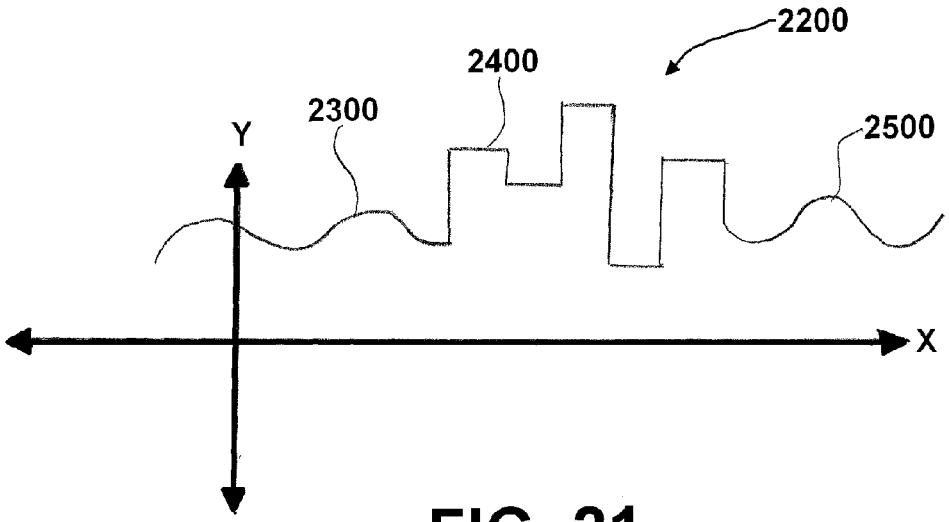
FIG. 21 shows a composite function example of various inputs during therapy.

FIG. 21 shows a composite function 2200 example of various inputs during therapy. Here, the function varying items in dome 100 can be a combination of more than one function 2300 (sinusoidal), 2400 (step), and 2500 (sinusoidal). Again, each one of the functions can be programmable for period, wavelength, amplitude, and average value.

Additionally, one or more oxygen outlets can be provided in the interior of the hyperbaric facility. The oxygen should be supplied through materials compatible therewith such as stainless steel, polymers, and/or other materials which do not substantially react with the oxygen. In one embodiment the level of oxygen can vary between a low of 21 percent to a high of 42 percent based on partial pressures.

In one embodiment even higher levels of oxygen (up to 100 percent) can be supplied to selected individuals through appropriate means, such as nasal tubes, masks, and/or hoods.

In one embodiment is provided a catastrophe shelter for civil defense, environmental and climatalogical disaster shelters (including the ability to modify interior pressure variants to external barometric pressure), homeland security, and military applications to protect occupants against terrorist attacks, biological warfare agents, chemical warfare agents, and nuclear or radiological blasts and radioactive fallout (NBC). This invention can be provided with separate airlocks and separate air supplies for decontamination and quarantine, all with varying bariatric pressures user programmable upon requirements and from which access can be provided directly into chamber. Design parameters can be increased for added protection, such as increasing the thickness of the high performance concrete, together with reinforcements. A deformable and trimmable rigid emergency repair kit, typically made from metallic sheets or Kevlar, carbon, or graphite fibers, can be provided which can be rapidly deployed to prevent depressurization from bullet, shrapnel, or rocket penetrations. Anchored in place by quick setting epoxy or cements, followed by applying layers of quick-setting high performance cements, such as magnesium oxide, for a permanent or semi-permament repair. Air quality can be insured on the incoming process airstream used for pressurization by: high efficiency particulate filtration; adiabatic compression (following the Ideal Gas Law, which states in part that when pressure increases temperature correlatively increases) to rapidly increase the temperature to 600 degrees F. or greater, followed by a rapid decrease of pressure which serves to sterilize biologicals and cause molecular dissociation of volatile organic compounds; plasma, either hot or cold, but preferably cold, which serves to sterilize biologicals and cause molecular dissociation of volatile organic compounds when air is passed through the corona, with enhanced effects if pure oxygen is introduced, generating mono-atomic allotropes of oxygen which is highly oxidative, or introducing hydrogen peroxide, which generates highly reactive hydroxyl ions, and where the allotropic oxygen and hydroxyl ions may be blended, if desired, by user programmability; and ultraviolet radiation in the C-band (UVC), centering at or about 254 nm in wavelength, which serves to sterilize biological organisms. Excess ions, both hydroxyl and ozone, as well as volatile organic compounds (VOC's), can be removed from the incoming and recirculated airstreams by means of an activated carbon filter media affixed across the airstream. Impregnating the activated carbon with selected dopants, such as potassium iodide, can enhance the removal of high and low molecular weight VOC's. The amount and types of ions in the air can be regulated using an automated sensor driven system.

In various embodiments the above described methods can be used for insuring interior air quality as it is being recirculated through climate control apparatus, either before or after. Self-contained living quarters can be provided with varying bariatric levels for short-term or long-term length of stay.

Construction

In various embodiments the shape of the dome can be formed from various materials, such as metal, pre-formed and pre-cast blocks made of expanded polystyrene foam (EPS) or cellular concrete, which is both lightweight and self-insulating, and can be continuously curvilinear or geodesic. These pre-formed building blocks or panels can be cemented and affixed into place. High strength and resistance to the expansive stress of interior pressure are easiest to achieve and most economical by spraying high performance blends of shotcrete over appropriate reinforcement, typically deformed iron rebar or post-tensioning cables arranged longitudinally and latitudinally. Since iron is magnetic, the utilization of iron rebar and/or cables for reinforcement in the dome envolope will generate a galvanic shell, or Ferriday Cage. Alternatively, non-magnetic reinforcements, such as bars or fibers made of basalt, glass, or polymers can be used to eliminate the galvanic shell.

The thickness of the shot-crete and the number, sizes, and types of reinforcement can be varied depending on desired usage. For use in military application, blast shields can be designed in increase impact resistance.

In one embodiment a reinforced concrete slab is poured, leaving a key-way joint. Pre-formed building blocks made of EPS or cellular concrete are cemented into place forming the shape of the dome. Deformed rebar and/or post-tensioning cables is suspended from the dome shell, then sprayed with consecutive thin layers of high performance concrete until built up to design thickness. Augments form the tunnels for the airlocks and are constructed in like manner. The exterior can then weatherproofed with an acrylic elastomeric coating.

In one embodiment the pre-formed, pre-cast building blocks are made of lightweight cellular concrete composed of magnesium phosphate, and which can optionally contain an admixture of cellulosic fibers.

In one embodiment the reinforcement is non-magnetic to eliminate the generation of a galvanic shell, or Ferriday Cage.

In one embodiment the pre-formed, pre-cast building blocks are made in a six-sided geodesic design, and can be made of various materials, including cellular concrete, magnesium phosphate, or EPS foam, are cemented into place forming the shape of the dome. Alternatively, the geodesic panels can be made of metal and welded into place, and can have an external reinforcing framework of a geometric design.

In one embodiment a reinforced concrete foundation is poured, leaving a keyway joint. A pre-lofted roofing membrane, such as polyvinyl chloride (PVC) or EDPM, is cemented to the perimeter for the foundation. Alternatively, a ring-beam can be poured and the remainder of the foundation poured at a later time. Vane-type blowers running continuously are used to inflate the roofing membrane which, when inflated, becomes an airform holding the shape of the dome and its augments. Closed-cell polyurethane foam insulation is sprayed onto the interior of the airform, rapidly hardening to form the permanent shape, at which time the blowers can be turned off. Alternatively, shot-crete, preferably with reinforcing fibers, can be sprayed onto the airform in thin, successive layers prior to the polyurethane foam, thus forming a hardened shell and which can be built up to application design thickness. Deformed rebar and/or post-tensioning cables is suspended from the dome shell, then sprayed with consecutive thin layers of high performance concrete until built up to design thickness. Augments form the tunnels for the airlocks and are constructed in like manner. The exterior can then additionally reinforced and sprayed with successive layers of shot-crete to reach design load. Additionally, the exterior can then weatherproofed with an acrylic elastomeric coating, if desired.

Alternate Embodiments

In one embodiment is provided a method and apparatus of using a hyperbaric facility comprising the steps of: (a) providing a hyperbaric dome, the dome including an interior and at least one double air lock for entering the interior; (b) increasing the pressure of the interior; and (c) a plurality of people entering the dome and excising.

In one embodiment the dome in comprises a dome, support ring, and floor, each of these components being structurally connected to each other by reinforcement.

In one embodiment the interior includes a plurality of exercise equipment including weight machines, treadmills, exercise bikes, free weights, rowing machines, ski machines, and training equipment. In one embodiment the interior includes at least one sauna. In one embodiment the sauna is an infra red sauna. In one embodiment the interior includes at least one oxygen supply which individuals can access for increasing the amount of oxygen breathed while in the dome.

In one embodiment is provided a method further comprising a second hyperbaric dome which is connected to the dome of step "a." In one embodiment the interior pressure of the second dome is different than the interior pressure of the dome of step "a." In one embodiment the domes are connected via a double air lock. In one embodiment is provided a method further comprising a third hyperbaric dome which is connected to the second dome. In one embodiment the three domes are connected via double air locks.

In one embodiment a cross section through one or more domes has the shape of a parabola. In one embodiment a cross section through one or more of the domes has the shape of an ellipse. In one embodiment the radius of curvature of one or more of the domes varies depending on the angular orientation from the floor.

In one embodiment one or more of the domes has a diameter between about 20 and about 1000 feet. In one embodiment the dome has a diameter between about 30 and about 900 feet. In one embodiment the dome has a diameter between about 40 and about 800 feet. In one embodiment the dome has a diameter between about 50 and about 700 feet. In one embodiment the dome has a diameter of at least about 75 feet. In one embodiment the dome has a diameter of at least about 100 feet. In one embodiment dome has a diameter of at least about 150 feet. In one embodiment the dome has a diameter of at least about 200 feet. In one embodiment the dome has a diameter of at least about 250 feet. In one embodiment the dome has a diameter of at least about 500 feet. In one embodiment the dome has a diameter of at least about 750 feet In one embodiment the dome has a diameter of at least about 1000 feet.

In one embodiment the pressure of the interior of the dome is maintained between about 1.2 and about 2.4 atmospheres. In one embodiment the pressure of the interior of the dome is maintained between about 1.2 and about 2.0 atmospheres In one embodiment the pressure of the interior of the dome is maintained between about 1.2 and about 1.8 atmospheres. In one embodiment the pressure of the interior of the dome is maintained between about 1.2 and about 1.6 atmospheres. In one embodiment the pressure of the interior of the dome is maintained between about 1.2 and about 1.5 atmospheres. In one embodiment the pressure of the interior of the dome is maintained between about 1.2 and about 1.3 atmospheres. In one embodiment the pressure of the interior is maintained between about 2 psi and about 20 psi above ambient pressure In one embodiment the pressure of the interior is maintained between about 3 psi and about 20 psi above ambient pressure. In one embodiment the pressure of the interior is maintained between about 4 psi and about 20 psi above ambient pressure In one embodiment the pressure of the interior is maintained between about 5 psi and about 20 psi above ambient pressure. In one embodiment the pressure of the interior is maintained between about 6 psi and about 20 psi above ambient pressure In one embodiment the pressure of the interior is maintained between about 7 psi and about 20 psi above ambient pressure. In one embodiment the pressure of the interior is maintained between about 8 psi and about 20 psi above ambient pressure. In one embodiment the pressure of the interior is maintained between about 9 psi and about 20 psi above ambient pressure In one embodiment the pressure of the interior is maintained between about 10 psi and about 20 psi above ambient pressure.

In one embodiment the interior of one or more of the domes includes a plurality of devices for measuring heart rate, breathing rate and body temperature of individuals inside the dome.

In one embodiment is provided a method and apparatus for using a hyperbaric facility comprising the steps of: (a) providing a hyperbaric dome, the dome including an interior, a support ring, and floor, wherein each of these components are structurally connected to each other by reinforcement bars; (b) increasing the pressure of the interior; and (c) a plurality of people entering the dome and excising.

In one embodiment the interior of one or more of the domes includes a plurality of exercise equipment including weight machines, treadmills, exercise bikes, free weights, rowing machines, ski machines, and training equipment In one embodiment the interior includes at least one sauna. In one embodiment the sauna is an infra red sauna. In one embodiment the interior includes at least one oxygen supply which individuals can access for increasing the amount of oxygen breathed while in the dome.

In one embodiment the method and apparatus further comprises a second hyperbaric dome which is connected to the dome of step "a." In one embodiment the interior pressure of the second dome is different than the interior pressure of the dome of step "a." In one embodiment the domes are connected via a double air lock. In one embodiment the method and apparatus further comprises a third hyperbaric dome which is connected to the second dome. In one embodiment the domes are connected via a double air lock. In one embodiment a cross section through at least one of the domes has the shape of a parabola. In one embodiment a cross section through the dome has the shape of an ellipse.

In one embodiment the radius of curvature of at least one of the domes varies depending on the angular orientation from the floor In one embodiment the dome has a diameter between about 20 and about 1000 feet. In one embodiment the dome has a diameter between about 30 and about 900 feet. In one embodiment the dome has a diameter between about 40 and about 800 feet. In one embodiment the dome has a diameter between about 50 and about 700 feet. In one embodiment the dome has a diameter of at least about 75 feet. In one embodiment wherein the dome has a diameter of at least about 100 feet. In one embodiment the dome has a diameter of at least about 150 feet. In one embodiment the dome has a diameter of at least about 200 feet. In one embodiment the dome has a diameter of at least about 250 feet. In one embodiment dome has a diameter of at least about 500 feet. In one embodiment the dome has a diameter of at least about 750 feet. In one embodiment dome has a diameter of at least about 1000 feet.

In one embodiment the pressure of the interior of the dome is maintained between about 1.2 and about 2.4 atmospheres. In one embodiment the pressure of the interior of the dome is maintained between about 1.2 and about 2.0 atmospheres. In one embodiment the pressure of the interior of the dome is maintained between about 1.2 and about 1.8 atmospheres. In one embodiment the pressure of the interior of the dome is maintained between about 1.2 and about 1.6 atmospheres. In one embodiment the pressure of the interior of the dome is maintained between about 1.2 and about 1.5 atmospheres. In one embodiment the pressure of the interior of the dome is maintained between about 1.2 and about 1.3 atmospheres. In one embodiment the pressure of the interior is maintained between about 2 psi and about 20 psi above ambient pressure. In one embodiment the pressure of the interior is maintained between about 3 psi and about 20 psi above ambient pressure. In one embodiment the pressure of the interior is maintained between about 4 psi and about 20 psi above ambient pressure. In one embodiment the pressure of the interior is maintained between about 5 psi and about 20 psi above ambient pressure. In one embodiment the pressure of the interior is maintained between about 6 psi and about 20 psi above ambient pressure. In one embodiment pressure of the interior is maintained between about 7 psi and about 20 psi above ambient pressure. In one embodiment the pressure of the interior is maintained between about 8 psi and about 20 psi above ambient pressure. In one embodiment the pressure of the interior is maintained between about 9 psi and about 20 psi above ambient pressure. In one embodiment the pressure of the interior is maintained between about 10 psi and about 20 psi above ambient pressure.

In one embodiment the interior of the dome includes a plurality of devices for measuring heart rate, breathing rate and body temperature of individuals inside the dome.

In one embodiment is provided a method and apparatus for using a hyperbaric facility comprising the steps of: (a) providing a plurality of hyperbaric domes interconnected to each other; (b) increasing the pressure of the interior; and (c) a plurality of people entering the dome and excising. In one embodiment wherein there are two domes In one embodiment there are three domes. In one embodiment there are more than three domes. In one embodiment each dome includes an interior, a support ring, and floor, wherein each of these components are structurally connected to each other by reinforcement bars.

In one embodiment the interiors of the domes each include a plurality of exercise equipment including weight machines, treadmills, exercise bikes, free weights, rowing machines, ski machines, and training equipment. In one embodiment the interior includes at least one sauna. In one embodiment the sauna is an infra red sauna. In one embodiment the interior includes at least one oxygen supply which individuals can access for increasing the amount of oxygen breathed while in the dome.

In one embodiment further comprising a second hyperbaric dome which is connected to the dome of step "a." In one embodiment wherein the interior pressure of the second dome is different than the interior pressure of the dome of step "a." In one embodiment the domes are connected via a double air lock. In one embodiment the method and apparatus includes a third hyperbaric dome which is connected to the second dome. In one embodiment the domes are connected via a double air lock. In one embodiment at least one of the domes includes a cross section through the dome having the shape of a parabola. In one embodiment a cross section through the dome has the shape of an ellipse. In one embodiment the radius of curvature of the dome varies depending on the angular orientation from the floor.

In one embodiment the dome has a diameter between about 20 and about 1000 feet. In one embodiment the dome has a diameter between about 30 and about 900 feet. In one embodiment the dome has a diameter between about 40 and about 800 feet. In one embodiment the dome has a diameter between about 50 and about 700 feet. In one embodiment the dome has a diameter of at least about 75 feet. In one embodiment the dome has a diameter of at least about 100 feet. In one embodiment the dome has a diameter of at least about 150 feet. In one embodiment the dome has a diameter of at least about 200 feet. In one embodiment the dome has a diameter of at least about 250 feet. In one embodiment the dome has a diameter of at least about 500 feet. In one embodiment the dome has a diameter of at least about 750 feet. In one embodiment the dome has a diameter of at least about 1000 feet.

In one embodiment the pressure of the interior of the dome is maintained between about 1.2 and about 2.4 atmospheres. In one embodiment the pressure of the interior of the dome is maintained between about 1.2 and about 2.0 atmospheres.

In one embodiment wherein the pressure of the interior of the dome is maintained between about 1.2 and about 1.8 atmospheres. In one embodiment the pressure of the interior of the dome is maintained between about 1.2 and about 1.6 atmospheres. In one embodiment the pressure of the interior of the dome is maintained between about 1.2 and about 1.5 atmospheres. In one embodiment the pressure of the interior of the dome is maintained between about 1.2 and about 1.3 atmospheres. In one embodiment the pressure of the interior is maintained between about 2 psi and about 20 psi above ambient pressure. In one embodiment the pressure of the interior is maintained between about 3 psi and about 20 psi above ambient pressure. In one embodiment the pressure of the interior is maintained between about 4 psi and about 20 psi above ambient pressure. In one embodiment the pressure of the interior is maintained between about 5 psi and about 20 psi above ambient pressure. In one embodiment the pressure of the interior is maintained between about 6 psi and about 20 psi above ambient pressure. In one embodiment the pressure of the interior is maintained between about 7 psi and about 20 psi above ambient pressure. In one embodiment the pressure of the interior is maintained between about 8 psi and about 20 psi above ambient pressure. In one embodiment the pressure of the interior is maintained between about 9 psi and about 20 psi above ambient pressure. In one embodiment the pressure of the interior is maintained between about 10 psi and about 20 psi above ambient pressure.

In one embodiment the interior of the dome includes a plurality of devices for measuring heart rate, PO2, breathing rate and body temperature of individuals inside the dome.

In one embodiment the dome does not have to be depressurized to facilitate the change of occupants.

In one embodiment the dome is a catastrophe, civil defense, homeland security, or military shelter.

In one embodiment the dome and its apparatus protects its occupants against natural or man-made disasters, including but not limited to: climatalogical, radiological, epidemics, pandemic disease, earthquake, tornado, and hurricane.

In one embodiment the dome and its apparatus protects against nuclear, radiological, biological, or chemical warfare agents.

Figure 22:
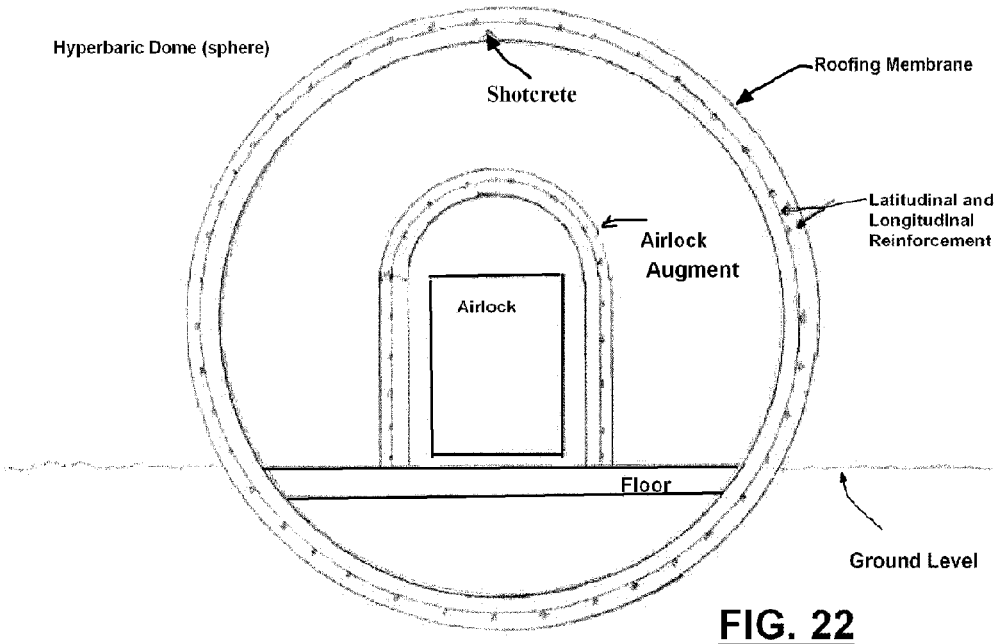
FIGS. 22 and 23 show two embodiments of a spherical dome.
Figure 23:
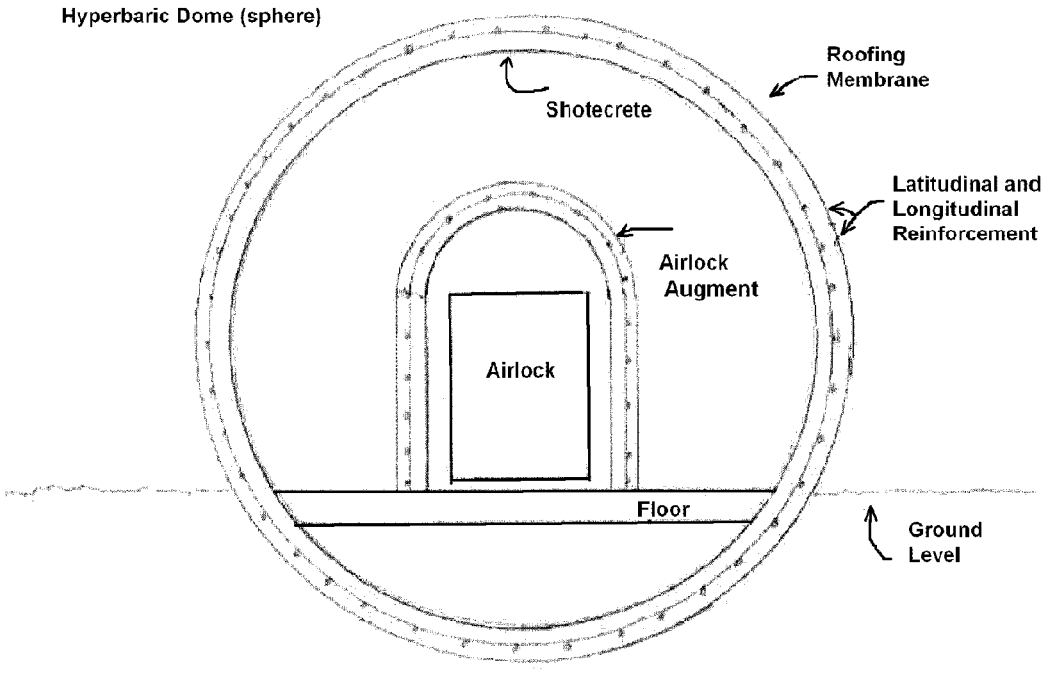

FIGS. 22 and 23 show embodiments of a spherical dome. In one embodiment at least a portion of one or more of the domes extends below the ground surface and maintains a domelike shape below the ground surface.

In various embodiments the dome can be a complete sphere with at least part of the sphere extending below the ground surface. In one embodiment the following percentages of a diameter can extend below the ground surface: about 5, 10, 15, 20, 25, 30, 35, 40, 45, 50, 55, 60, 65, 70, 75, 80, 85, 90, 95, and 100 percent. In various embodiments a range of between about any two of the specified percentages can be used.

In various embodiments the dome can be a partially complete sphere with at least part of the partially complete sphere extending below the ground surface. Here a horizontal plane cutting off the dome can be used to make the floor surface. In one embodiment the horizontal plane intersects the dome at the following radial percentage: about 5, 10, 15, 20, 25, 30, 35, 40, 45, 50, 55, 60, 65, 70, 75, 80, 85, 90, 95, and 100 percent. In various embodiments a range of intersection of between about any two of the specified percentages can be used. In one embodiment the intersecting plane forms the floor of the dome and the floor is located below a ground surface. In one embodiment the following percentages of the radius can be used to provide the underground location the intersecting plane or flow below the ground surface: about 5, 10, 15, 20, 25, 30, 35, 40, 45, 50, 55, 60, 65, 70, 75, 80, 85, 90, 95, and 100 percent. In various embodiments a range of between about any two of the specified percentages can be used.

In various embodiments the dome actually increases in size when below the ground surface (or a horizontal great circle of the dome is located below the ground surface). In one embodiment the horizontal great circle is located at the following radial percentage: about 5, 10, 15, 20, 25, 30, 35, 40, 45, 50, 55, 60, 65, 70, 75, 80, 85, 90, 95, and 100 percent. In various embodiments a range of intersection of between about any two of the specified percentages can be used.

The following is a list of reference numerals:

LIST FOR REFERENCE NUMERALS

| (Reference No.) | (Description) |
|---|---|
| 10 | apparatus/facility |
| 20 | support ring |
| 30 | top |
| 40 | bottom |
| 50 | length |
| 60 | reinforcement |
| 62 | reinforcement |
| 64 | reinforcement |
| 66 | reinforcement |
| 68 | reinforcement |
| 70 | reinforcement |
| 72 | reinforcement |
| 74 | reinforcement |
| 76 | reinforcement |
| 78 | reinforcement |
| 80 | reinforcement |
| 82 | reinforcement |
| 84 | reinforcement |
| 86 | reinforcement |
| 88 | reinforcement |
| 90 | reinforcement |
| 92 | reinforcement |
| 94 | reinforcement |
| 96 | reinforcement |
| 98 | reinforcement |
| 100 | dome |
| 110 | top |
| 120 | bottom |
| 124 | perimeter rib |
| 130 | interior |
| 140 | thickness |
| 150 | front |
| 160 | rear |
| 170 | inlet |
| 200 | floor |
| 204 | perimeter groove |
| 210 | exercise portion |
| 220 | first area |

-continued

LIST FOR REFERENCE NUMERALS

| (Reference No.) | (Description) |
|---|---|
| 230 | second area |
| 240 | third area |
| 250 | machine |
| 260 | machine |
| 270 | machine |
| 280 | machine |
| 290 | machine |
| 300 | machine |
| 310 | machine |
| 320 | machine |
| 350 | sauna |
| 360 | sauna |
| 370 | oxygen station |
| 400 | entrance |
| 405 | person/individual |
| 410 | first side |
| 420 | second side |
| 430 | interior |
| 440 | floor |
| 450 | walls |
| 460 | door |
| 470 | door |
| 490 | arrow |
| 500 | arrow |
| 510 | arrow |
| 530 | arrow |
| 540 | arrow |
| 800 | pressurizing system |
| 900 | venting system |
| 1000 | dome geometry |
| 1010 | highest point/top |
| 1020 | distance to highest point/top |
| 1030 | side |
| 1040 | base |
| 1100 | dome geometry |
| 1110 | highest point/top |
| 1120 | distance to highest point/top |
| 1130 | side |
| 1140 | base |
| 1200 | dome geometry |
| 1210 | highest point/top |
| 1220 | distance to highest point/top |
| 1230 | side |
| 1240 | base |
| 1300 | dome geometry |
| 1310 | highest point/top |
| 1320 | distance to highest point/top |
| 1330 | side |
| 1340 | base |
| 2000 | function |
| 2010 | average value |
| 2020 | lower value |
| 2030 | amplitude |
| 2040 | wavelength |
| 2050 | period |
| 2100 | change in activity point |
| 2110 | change in activity point |
| 2120 | change in activity point |
| 2200 | composite function |
| 2300 | first function |
| 2400 | second function |
| 2500 | third function |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A method of using a hyperbaric facility to exercise comprising the steps of:

a) providing a first hyperbaric dome, the first dome including a first exterior domed reinforced concrete wall and a reinforced concrete floor surrounding an interior, and a pressure regulating system which controls the pressure of the interior of the first dome;

b) providing at least one double air lock for entering the interior of the first dome;

c) providing a second hyperbaric dome including a second exterior domed reinforced concrete wall, the second dome being connected to the first dome of step "a" by the at least one double air lock;

d) a plurality of people entering the first dome and exercising within the first dome; and e) the pressure regulating system increasing the pressure of the interior of the first dome to at least 1.2 atmospheres; wherein neither the first or second dome is located with the respective other first or second dome.

2. The method of claim 1, wherein the dome in step "a" comprises a dome shaped wall, a floor, a support ring at floor and wall interface, each of these components being structurally connected to each other by reinforcement.

3. The method of claim 1, wherein in step "e" the first dome includes a joint including interlocking portions of the domed wall and floor.

4. The method of claim 1, wherein in step "e" the pressure is between about 1.2 and 2.0 atmospheres.

5. The method of claim 1, wherein in step "e" the pressure is programmable to vary between about 1.2 and 2.4 atmospheres.

6. The method of claim 1, wherein there are multiple domes in step "a" that are connected via a double air lock.

7. The method of claim 2, wherein in step "e" the first dome includes a joint including interlocking portions of the domed wall and the floor at a position above the ring.

8. The method of claim 1, wherein the interior pressure of the second dome is different than the interior pressure of the dome of step "a."

9. The method of claim 1, wherein the first dome includes a programmable oxygen regulatory system used to regulate and vary the partial pressure of oxygen in the interior of the first dome over a time period.

10. The method of claim 9, wherein the level of oxygen is programmable to vary over a set period of time between 21 to 41 percent based on partial pressure of the oxygen.

11. The method of claim 9, wherein the level of oxygen varies over a non-linear pattern.

12. The method of claim 1, wherein in step "e" the first dome includes a joint including the ring positioned vertically under the wall and the floor in between the ring and domed wall.

13. The method of claim 1, wherein the pressure of the interior of the dome is maintained between about 1.2 and about 1.8 atmospheres.

14. The method of claim 1, wherein the pressure of the interior is maintained between about 2 psi and about 20 psi above ambient pressure.

15. The method of claim 1, wherein the interior includes a plurality of exercise machines.

16. The method of claim 1, wherein the interior includes at least one oxygen supply which individuals can access for increasing the amount of oxygen breathed while in the dome.

17. The method of claim 1, wherein in step "d" each person entering the dome enters the double air lock when the double air lock is at a first pressure, and then enters the dome after the double air lock is elevated to a second pressure that is higher than the first pressure.

18. The method of claim 1, further including, in step "d", each person leaving the first dome enters the double air lock when the double air lock is at a first pressure and then leaves the double air lock after the double air lock is lowered to a second pressure that is lower than the first pressure.

* * * * *